US008826690B2

(12) United States Patent
Pidarow

(10) Patent No.: US 8,826,690 B2
(45) Date of Patent: Sep. 9, 2014

(54) FOOD TRAY

(76) Inventor: Maher Pidarow, Sagamore Hills, OH (US)

( * ) Notice: Subject to any disclaimer, the term of this patent is extended or adjusted under 35 U.S.C. 154(b) by 1112 days.

(21) Appl. No.: 12/618,646

(22) Filed: Nov. 13, 2009

(65) Prior Publication Data

US 2011/0113794 A1 May 19, 2011

(51) Int. Cl.

| | |
|---|---|
| ***F17C 13/00*** | (2006.01) |
| ***F25D 25/00*** | (2006.01) |
| ***F25D 3/08*** | (2006.01) |
| ***F17C 1/00*** | (2006.01) |
| ***F17C 3/00*** | (2006.01) |
| ***A47G 23/04*** | (2006.01) |
| ***F25D 11/00*** | (2006.01) |

(52) U.S. Cl.

CPC ..... *F25D 11/00* (2013.01); *A47G 23/04* (2013.01); *F25D 2331/812* (2013.01); *F25D 2400/12* (2013.01)

USPC ..... 62/457.9; 62/62; 62/457.1; 62/457.2; 62/457.7; 62/3.2; 220/560.09; 220/495.03; 220/62.13; 220/23.83; 220/23.86; 220/575

(58) Field of Classification Search

USPC ..... 62/457.9, 62, 457.1, 457.2, 457.7, 3.2, 62/3.62, 3.6, 23.88, 23.83, 23.86; 220/560.09, 495.03, 62.13, 23.83, 220/23.86, 575

See application file for complete search history.

(56) References Cited

U.S. PATENT DOCUMENTS

| | | | | | |
|---|---|---|---|---|---|
| 1,768,976 | A | * | 7/1930 | Cuthbertson | 220/575 |
| 2,789,608 | A | * | 4/1957 | Tupper | 220/792 |
| 2,879,507 | A | | 3/1959 | Bonistall | |
| 2,978,285 | A | | 4/1961 | Jester | |
| 3,349,941 | A | * | 10/1967 | Wanderer | 220/23.88 |
| 3,385,465 | A | * | 5/1968 | Bliss | 220/23.4 |
| 3,769,805 | A | * | 11/1973 | Corini | 62/3.6 |
| 3,972,419 | A | | 8/1976 | Short | |
| 4,315,650 | A | * | 2/1982 | Yoshida | 446/390 |

(Continued)

FOREIGN PATENT DOCUMENTS

| | | |
|---|---|---|
| WO | 01/69145 | 9/2001 |
| WO | 2004/005809 | 1/2004 |
| WO | 2006/100476 | 9/2006 |
| WO | 2007/052907 | 5/2007 |

*Primary Examiner* — Judy Swann
*Assistant Examiner* — Claire Rojohn, III
(74) *Attorney, Agent, or Firm* — Christopher Paul Mitchell

(57) ABSTRACT

Tray having a container receiving space and a stepped outer sidewall including a lower step and an upper step, a cooling unit providing cooled air to the space and having a housing with a stepped base that includes a lower step and an upper step, the cooling unit venting exhaust from an end distal to the base, a plurality of containers each having a perimeter flange and, when the container is inserted into the space, portions of the flange are seated on the respective lower steps of the tray and the stepped base of the housing, and a cover configured to sealingly contact the upper steps when the cover is in a closed position, the cover shielding the containers from the exhaust, and being movably attached to the housing and movable along the housing in a range that includes the closed position at which the cover contacts the upper steps.

15 Claims, 40 Drawing Sheets

(56) References Cited

U.S. PATENT DOCUMENTS

| | | | | |
|---|---|---|---|---|
| 4,726,193 | A | 2/1988 | Burke et al. | |
| 4,848,091 | A | 7/1989 | Border | |
| 6,182,839 | B1 * | 2/2001 | Robbins et al. | 211/78 |
| 6,732,533 | B1 | 5/2004 | Giles | |
| 6,763,666 | B2 | 7/2004 | Fong | |
| 7,225,633 | B2 * | 6/2007 | DeMars | 62/457.6 |
| 2004/0006997 | A1 | 1/2004 | Clark et al. | |
| 2005/0274119 | A1 | 12/2005 | Lee | |
| 2006/0000221 | A1 | 1/2006 | Culp et al. | |
| 2006/0213206 | A1 | 9/2006 | Linder | |
| 2008/0124440 | A1 * | 5/2008 | Anderson et al. | 426/523 |

* cited by examiner

FOOD TRAY

BACKGROUND

1. Field

Embodiments of the present invention relate generally to food trays and, more particularly, to food preserving and presenting trays.

2. Description of Related Art

It is known that consuming a healthy, balanced diet, one that includes sufficient quantities and varieties of fruits and vegetables, is a primary factor in maintaining good health. Such a diet is also a primary factor in combating many of today's health concerns, such as obesity. Nonetheless, despite increased media focus on the benefits of consuming a healthy diet, it is estimated that a majority of Americans do not.

There are myriad factors contributing to this deficiency, some of which include competition by well-marketed and well-presented fast food, increasingly busy lifestyles, and the rise of a culture of convenience that often includes nutritionally reduced, pre packaged, processed food.

Accordingly, there is a need for a way to deliver fruits and vegetables that is easy to use and maintain as well as convenient.

BRIEF SUMMARY

According to an aspect of the invention, there is provided a device. The devices includes a tray having a container receiving space and a stepped outer sidewall including a lower step and an upper step, a cooling unit providing cooled air to the space and having a housing with a stepped base that includes a lower step and an upper step, the cooling unit venting exhaust from an end distal to the tray, a plurality of containers each having a perimeter flange and, when the container is inserted into the space, portions of the flange are seated on the respective lower steps of the tray and the stepped base of the housing, and a cover configured to sealingly contact the upper steps when the cover is in a closed position, the cover shielding the containers from the exhaust, and being movably attached to the housing and movable along the housing in a range that includes the closed position at which the cover contacts the upper steps.

According to another aspect of the present invention, there is provided a device. The device includes a container accepting tray removably accepting at least two containers at portions of respective peripheral flanges of the containers, the tray having inner and outer ledges and a longitudinal axis, a seal being established between portions of the flanges and the inner ledge of the tray when the containers are accepted, a cooling unit extending along the axis, having a base end proximate to the tray and a distal exhaust end from which warm air is exhausted, the cooling unit being freestanding, removably connected to the tray, and having a housing including a base with inner and outer ledges, a seal being established between portions of the flange and the outer ledge of the base of the housing when the containers are accepted, and a movable cover, the cover extending between the outer ledge of the tray and the inner ledge of the housing, being movable along the axis from a closed position at which the cover sealingly contacts the outer ledge of the tray and the inner ledge of the housing to an open position at which the cover is not in contact with the ledges, and being movably attached to the housing and shielding the tray from the exhaust air.

According to another aspect of the present invention, there is provided a method. The method includes suspending containers in a space of a tray by only portions of peripheral flanges of the containers, the tray having a stepped outer wall including a first step on which portions of the flanges of containers inserted into the space sit and a second step higher than the first step, the containers being suspended so that bottom portions thereof are spaced from a bottom of the tray, cooling the space via a cooling unit centrally disposed about the tray, the cooling unit being removably connected to the tray at a first end of an erecting structure and exhausting at a second end of the erecting structure distal from the tray, the cooling unit having a housing with a stepped base including a first step on which portions of the flanges of the inserted containers sit, and shielding the containers from the exhaust via a cover that is movably connected to the housing, movable through a range along an axis of the cooling unit, and suspendable at positions in the range, the range including a closed position in which the cover is in sealed contact with the second steps.

The foregoing and other aspects will become apparent from the following detailed description when considered in conjunction with the accompanying drawing figures.

DETAILED DESCRIPTION

Figure 1A:
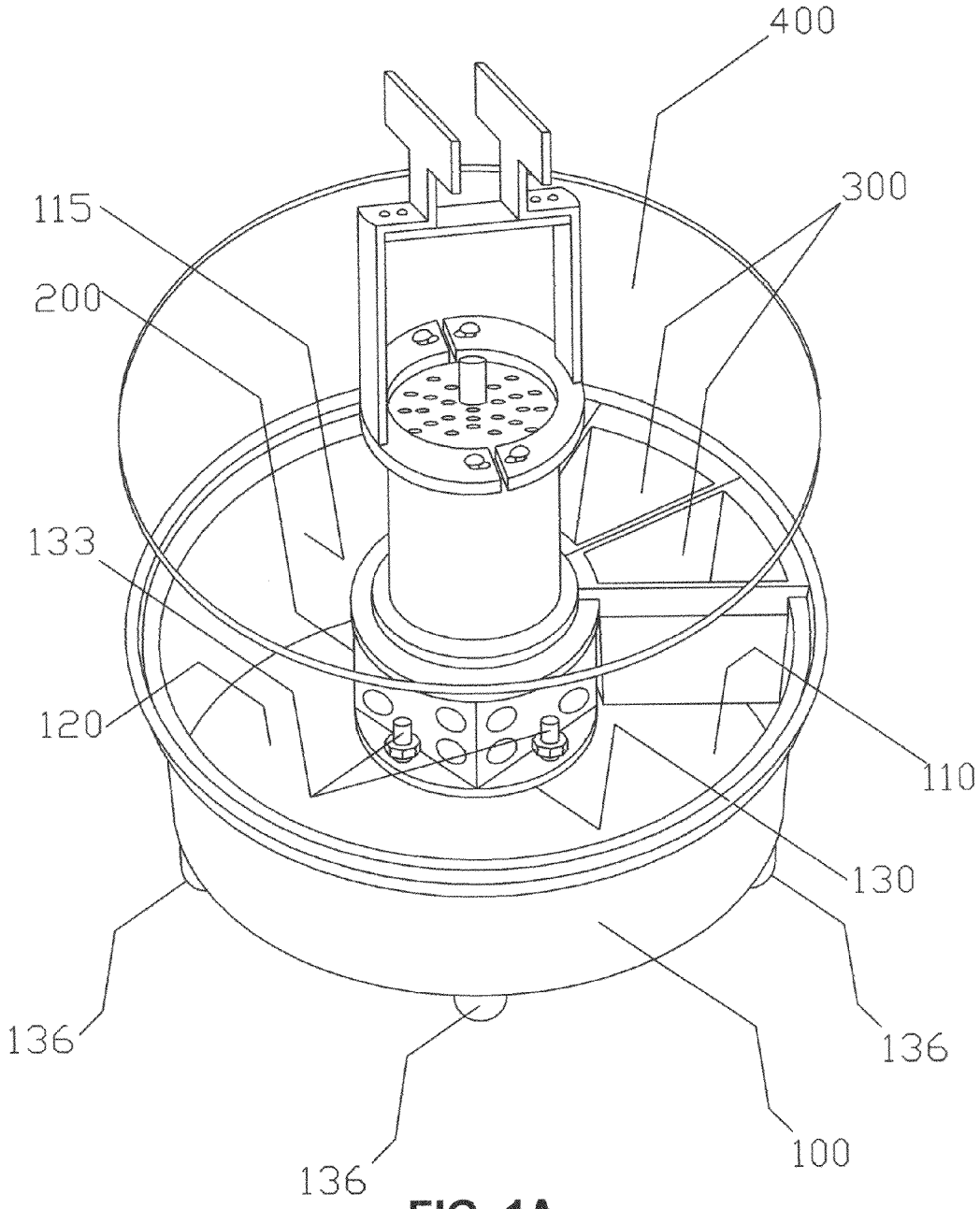
FIG. 1A-1B are exploded perspective views of an apparatus according to a first embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As used in this application, the terms "a", "an" and "the" may refer to one or more than one of an item. The terms "and" and "or" may be used in the conjunctive or disjunctive sense and will generally be understood to be equivalent to "and/or". For brevity and clarity, a particular quantity of an item may be described or shown while the actual quantity of the item may differ. Features from an embodiment may be combined with features of another.

First Embodiment

Figure 1B:
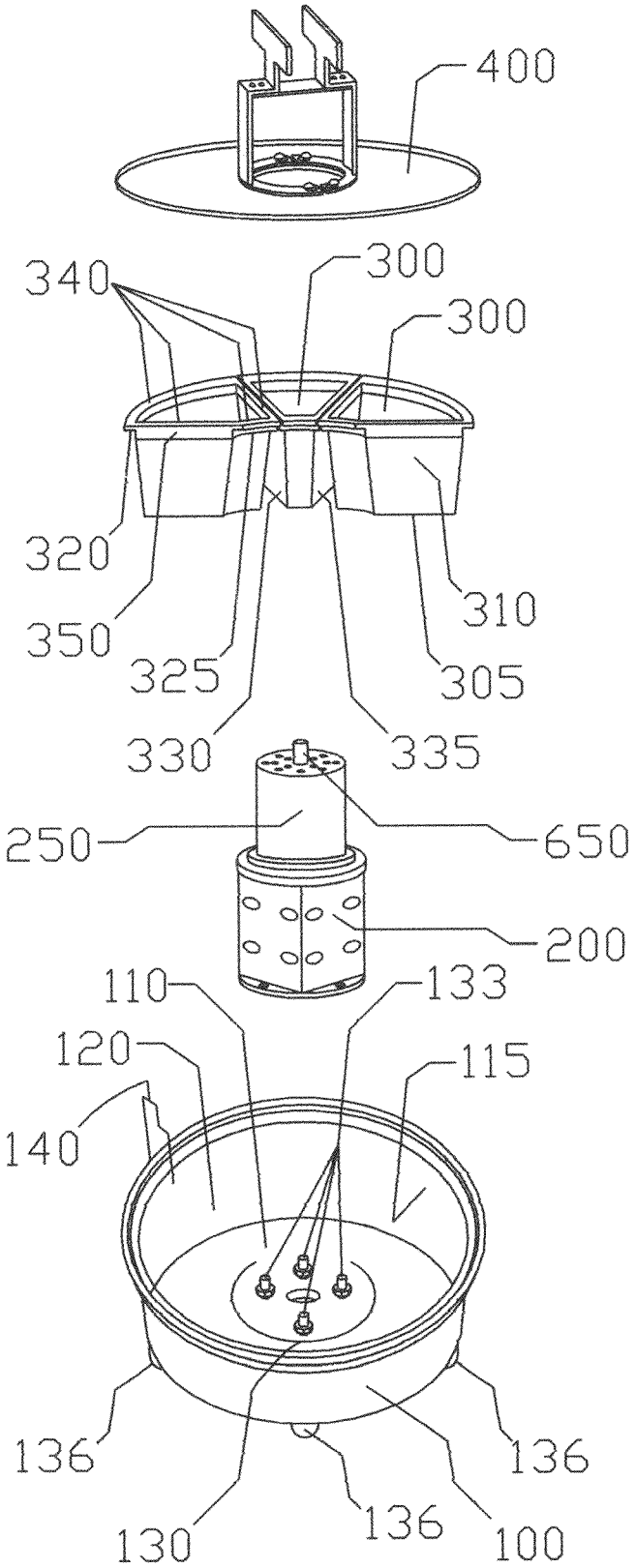

Referring to FIG. 1A, and FIG. 1B, there is shown an exploded perspective view of an apparatus according to an embodiment of the present invention. The apparatus may include a tray 100, a cooling unit 200, a plurality of food containers 300, and a tray cover 400. The cooling unit 200 may be removably mounted to the tray 100. The plurality of food containers 300 may be accepted by and independently suspended in the tray 100.

The Tray

The tray 100 may be a receptacle for the food containers 300. The tray 100 may include a bottom 110 and at least one sidewall 115. Collectively, the bottom and the at least one sidewall may define an interior or space 120. As will be explained in detail below, the cooling unit 200 may cool the interior 120. The number of sidewalls may depend on the shape of the tray, which may vary. For example, when the tray is generally circular, the number of sidewalls may be one.

The dimensions and configuration of the tray 100 may vary. For example, the depth of the tray may be varied. The bottom 110 of the tray may be spaced from the food containers 300 when they are received in the tray 100. Also, the tray 100 may be any shape that suitably accepts and receives the food containers 300. Non-limiting examples of the shape of the tray 100 include a circle, an oval, a square, a triangle, and a rectangle.

The tray 100 may be made of any material that provides sufficient insulation properties. Non-limiting examples of suitable materials include plastic, ceramic, stoneware, glass, stainless steel, wood, and fiberglass. It may be preferable, in some applications, to select materials that are more easily cleaned and/or dishwasher safe.

As illustrated in FIG. 1B, The tray 100 may include a mounting arrangement 130 extending from the inside bottom 110 of the tray 100. The mounting arrangement 130 may removably interconnects the cooling unit 200 to the tray 100. The mounting arrangement may include, by way of non-limiting example, plural mounting posts 133 adapted to cooperate with complimentary mounting structures on the cooling unit 200, as will be described below. The mounting posts 133 may be either integrally formed with the tray 100 or attached to the bottom of the tray via a conventional process such as, by way of non-limiting examples, heat welding, adhesive, and/or a mechanical fastener. Dimensions and configuration of the mounting arrangement 130 may vary. The mounting arrangement may mount the cooling unit 200 in a spaced manner such that an adequate flow of air may be available to the cooling unit. The mounting arrangement may mount the cooling unit 200 in a spaced manner such that an opening in the tray 100 provided for receiving a power cord to power the cooling unit is sealed. Also, the number and arrangement of the mounting posts 133 may vary. The number of posts may be at least three and may be arranged to provide a plane. As is known in the art, at least three points define a plane. The mounting arrangement 130 may be located at the substantial center of the bottom of the tray 100.

Additionally or alternatively, the tray may include a plurality of legs 136 extending from the outside bottom of the tray 100 toward the surface on which the apparatus rests. The legs may be either integrally formed with the tray 100 or attached to the bottom of the tray via a conventional process such as, by way of non-limiting examples, heat welding, adhesive, and/or a mechanical fastener. The number and arrangement of the legs 136 may vary. The number of legs may be at least three, so as to define a plane. The configuration of the legs may also be varied.

Figure 3A:
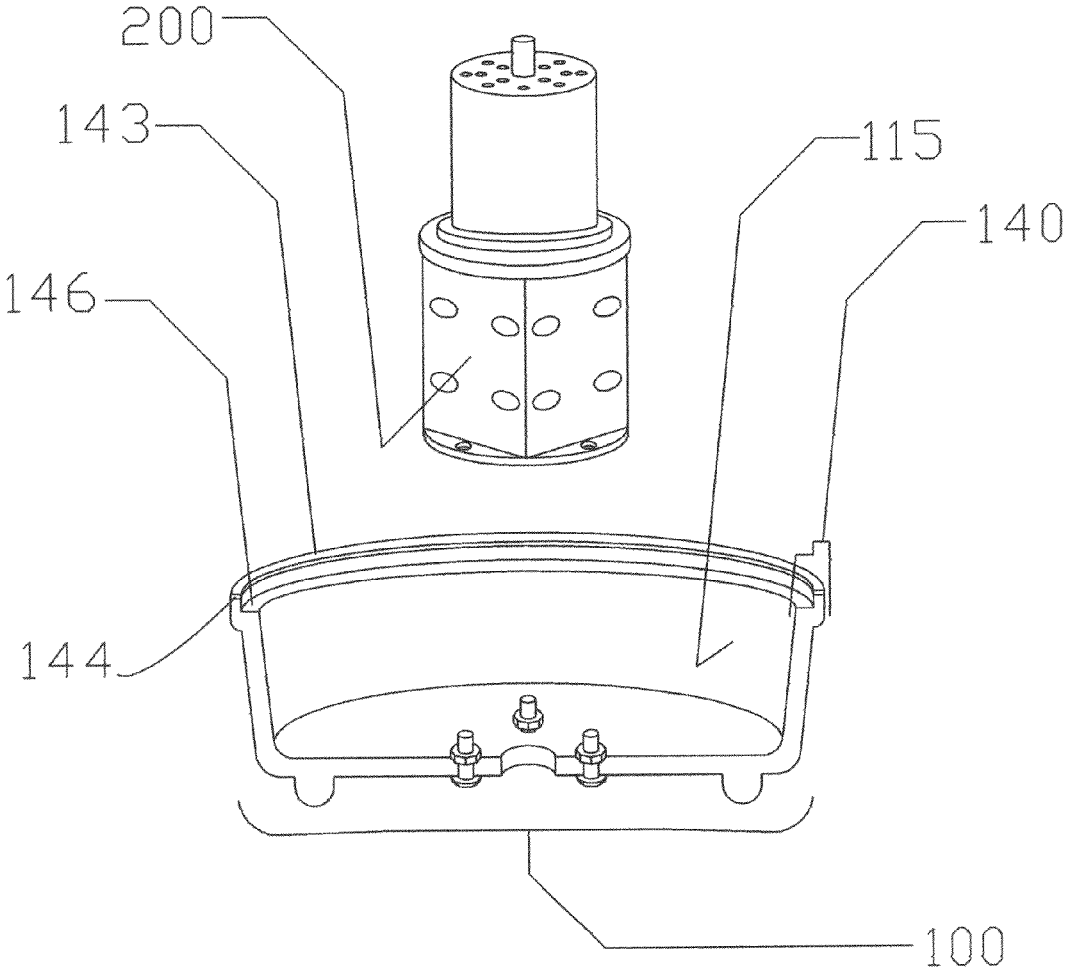
FIGS. 3A-3B are section views of alternative configurations of a tray according to the first embodiment.

Referring to FIG. 3A the tray 100 may include a stepped formation 140 at the top edge of the sidewall 115 of the tray. This stepped formation 140 may extend around the perimeter of the tray 100. The stepped formation 140 may include an upper ledge or step 143 and a lower ledge or step 146. These upper and the lower ledges may be horizontal and may be substantially smooth. As illustrated in FIG. 3D and will be explained in detail below, when the tray cover 400 is in the closed position, it may be seated on the smooth, horizontal surface of upper ledge 143. The interface between the tray cover 400 and the upper ledge 143 may be a sealing one. As illustrated in FIG. 3C and will be explained in more detail below, a portion of each food container 300 may rest on the horizontal surface of the lower ledge 146. The dimensions and configuration of the stepped formation 140 may vary. The top most side of each food container 300 may be held at or below the level of the upper ledge 143.

Figure 3B:
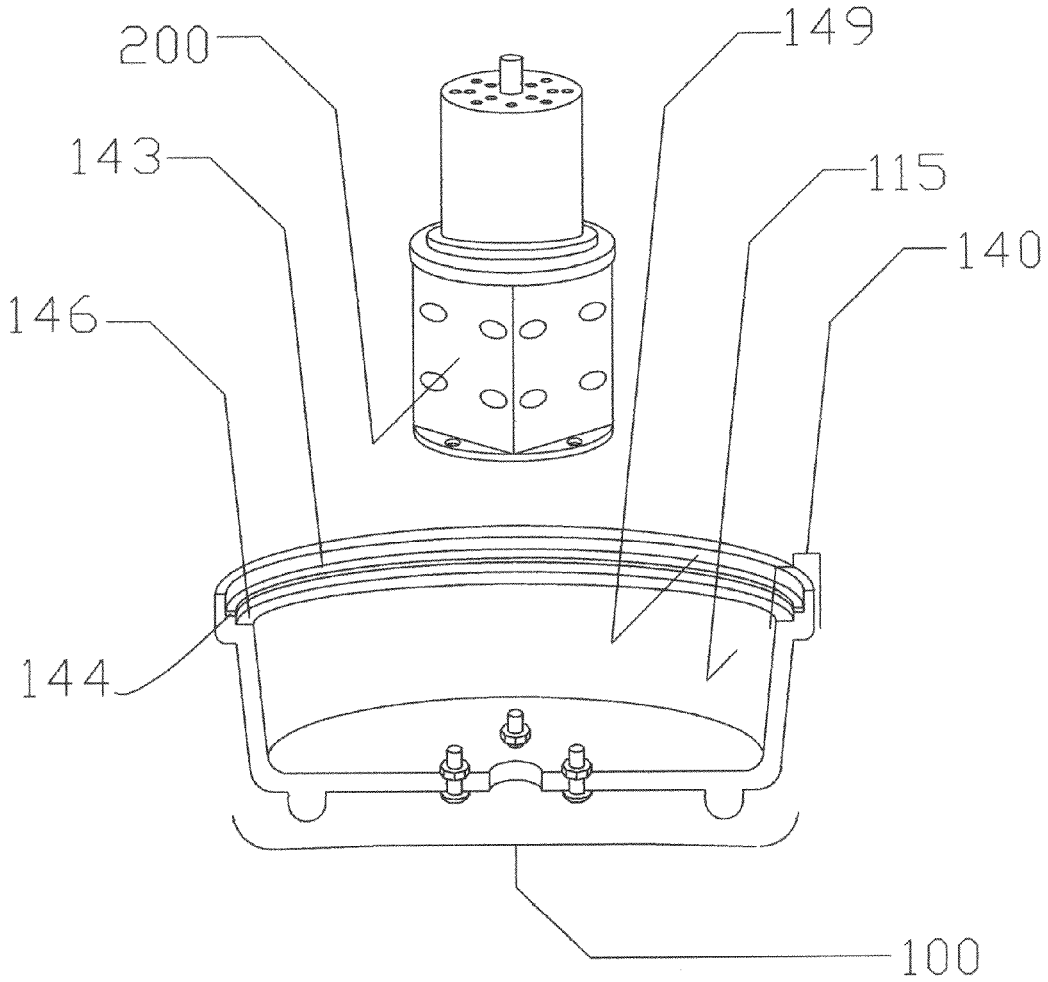
Figure 3C:
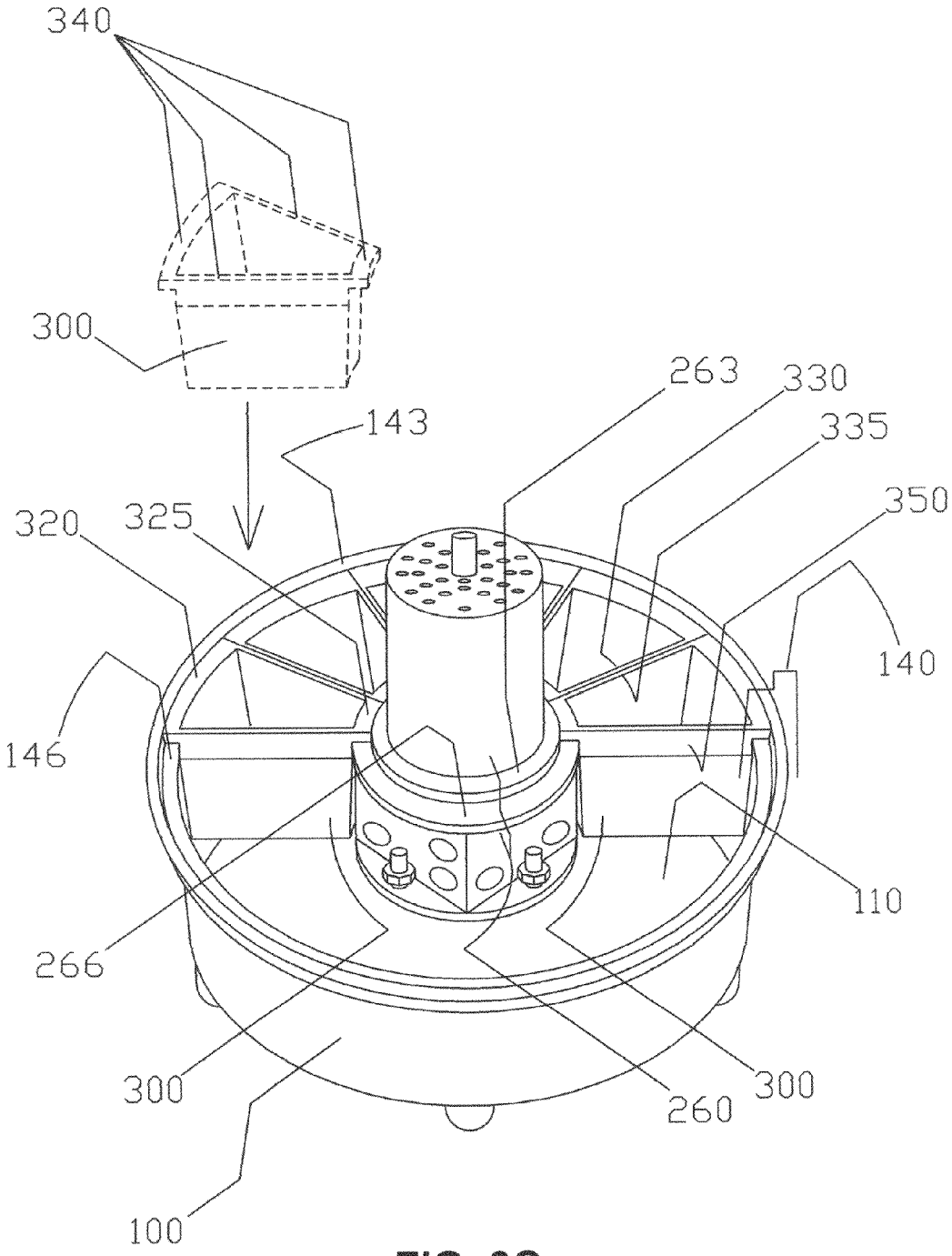
FIG. 3C-3E are various perspective views of a tray according to the first embodiment.
Figure 3D:
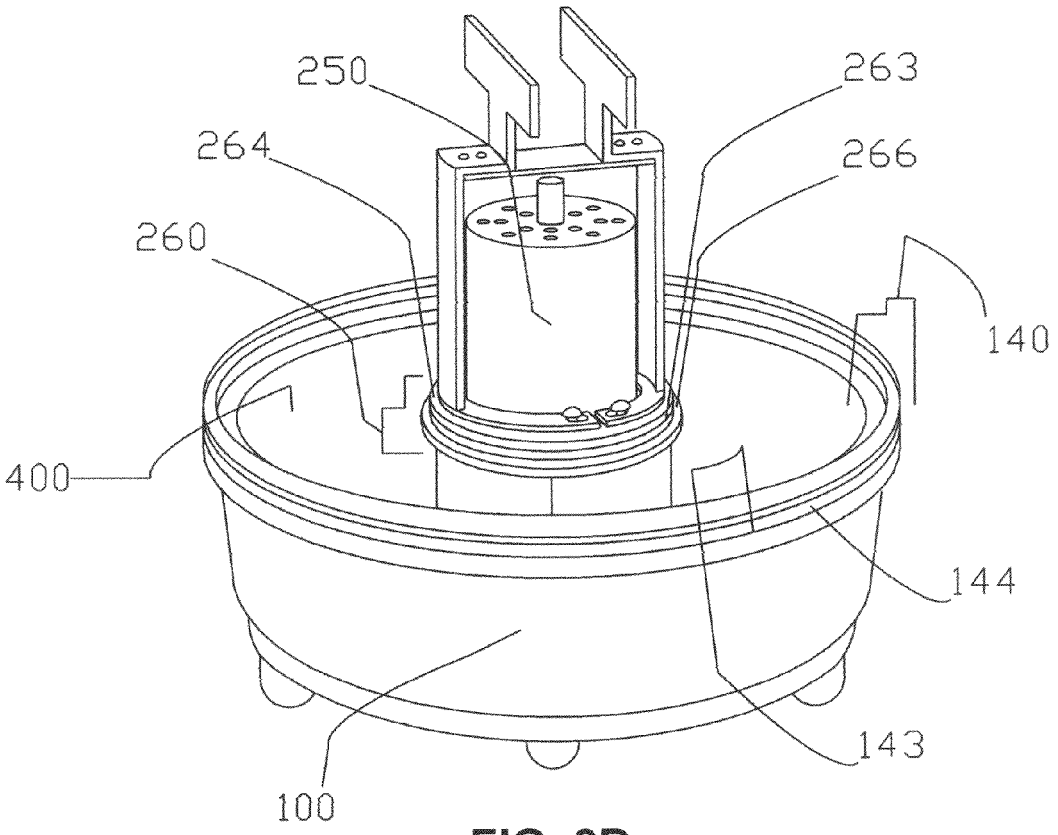

Alternatively, as illustrated by FIG. 3B, the stepped formation 140 includes upper and lower ledges 143, 146 along with a perimeter ridge 149 extending above the upper ledge. In this configuration, the tray cover 400 seats on the upper ledge 143 and within the perimeter ridge 149. This configuration, the inventor has discovered, results in an increased seal between the tray cover 400 and the tray 100. Additionally, this configuration promotes a generally more aesthetic appearance, since the edge of the tray cover 400 is not visible when the cover is in the closed position.

Additionally or alternatively, as illustrated in FIGS. 3A, 3B, and 3D, regardless of the configuration of the stepped formation 140, a gasket 144 may be provided on the upper ledge 143 of the tray 100 to facilitate the sealing contact between the tray cover 400 and the upper ledge 143, when the tray cover 400 is in the closed position.

The Cooling Unit

Figure 5A:
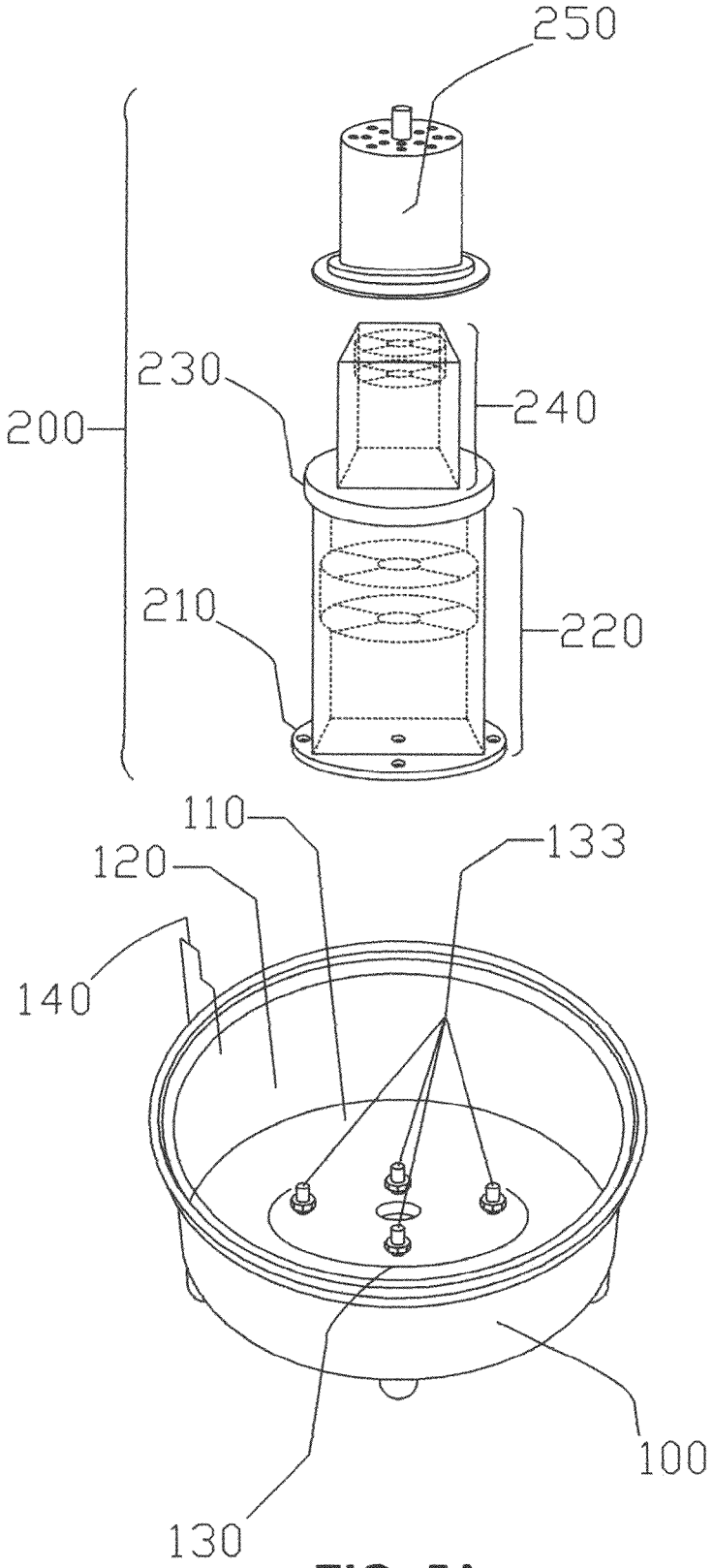
FIGS. 5A-5C, and 5F are exploded perspective views of a cooling unit according to the first embodiment.

Referring to FIG. 5A, there is illustrated an exploded, perspective view of the cooling unit 200. As illustrated in FIG. 1A, The cooling unit 200 may cool the air in the interior 120 of the tray 100 and thus may cool items in the food containers 300 when they are received in the interior of the tray. The cooling unit 200 may be freestanding and removably mounted to the bottom 110 of the tray 100.

The cooling unit 200 may include, from the bottom of the cooling unit upwards (bottom to top as illustrated in FIG. 5A), a mounting portion 210, a lower portion 220, a plate 230, an upper portion 240, and a housing 250.

The mounting portion 210 may cooperate with the mounting arrangement 130 of the tray 100 to removably mount the cooling unit 200 to the substantial center of the tray 100. Thus, the mounting portion 210 has a configuration that may compliment that of the mounting arrangement 130. By way of a non-limiting example, when the mounting arrangement includes four mounting posts 133, the mounting portion 210 may include four holes that accept respective ones of the mounting posts.

The plate 230 may be substantially disk-shaped and may separate the upper portion 240 and the lower portion 220 of the cooling unit 200.

Figure 5B:
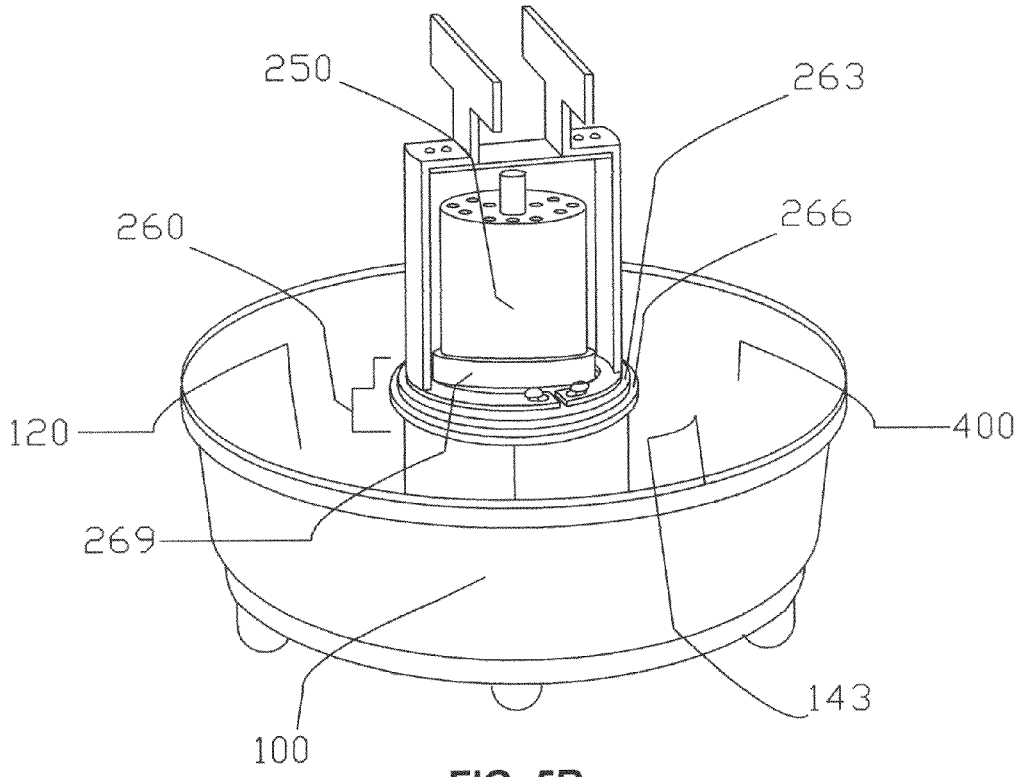
Figure 5C:
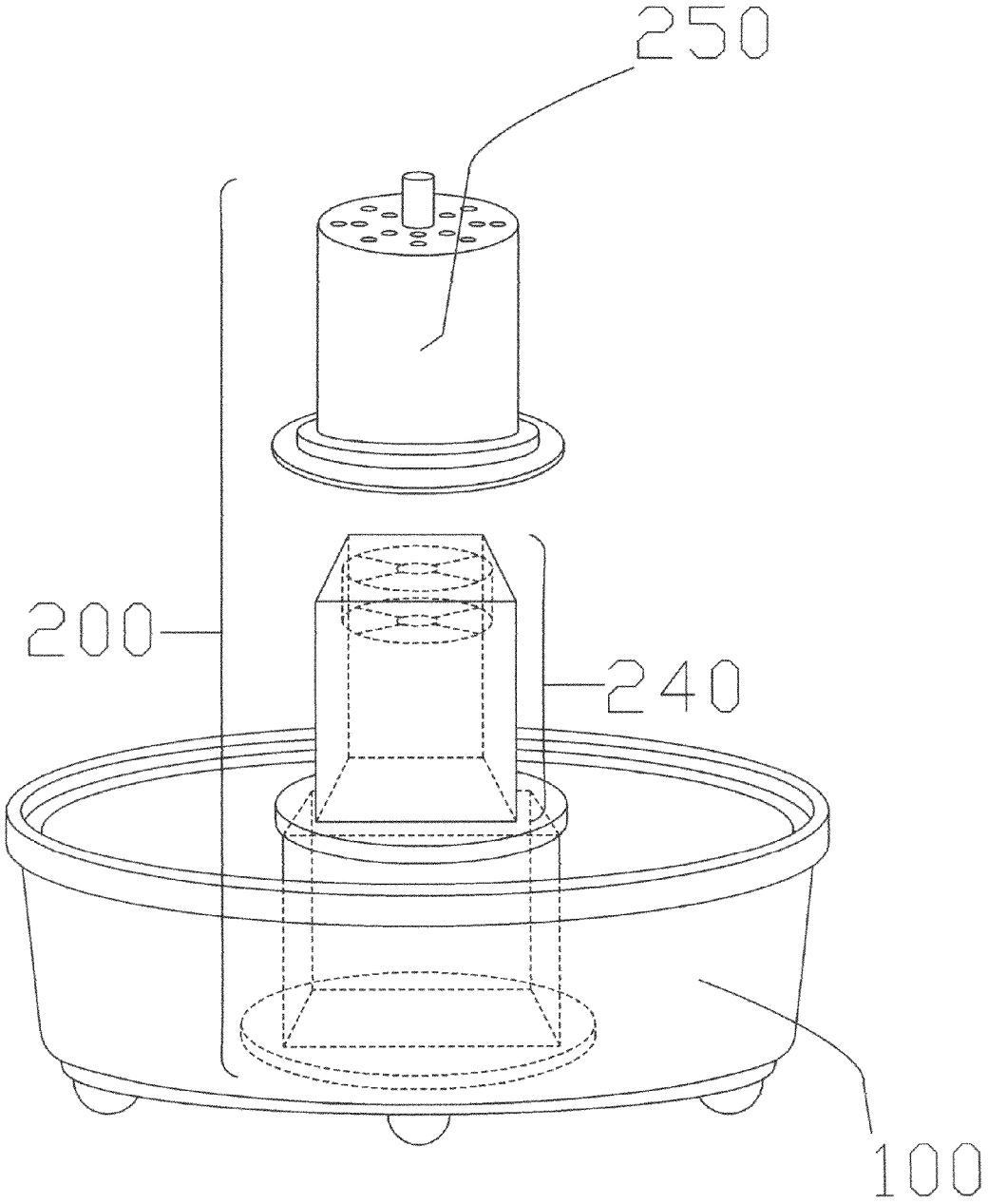
Figure 5D:
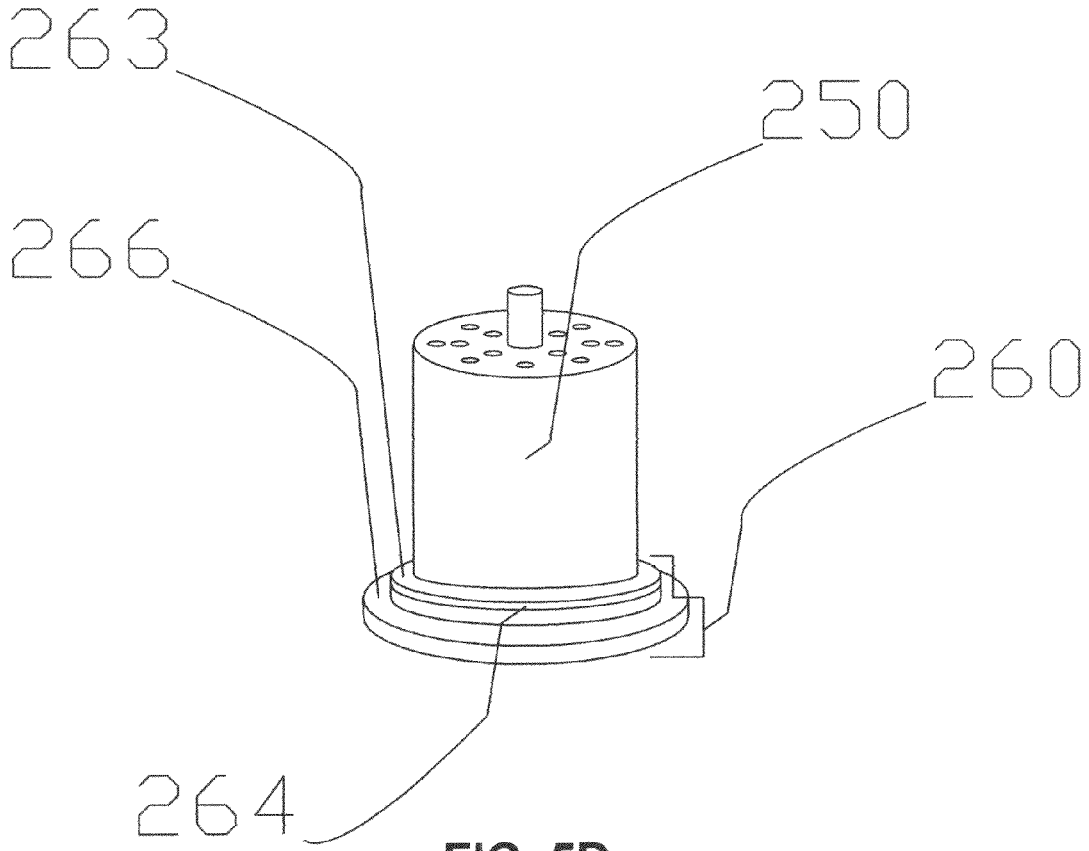
FIG. 5D-5E are perspective elevation views of alternative configurations of the stepped formation of the base of the housing of the cooling unit according to the first embodiment.
Figure 11:
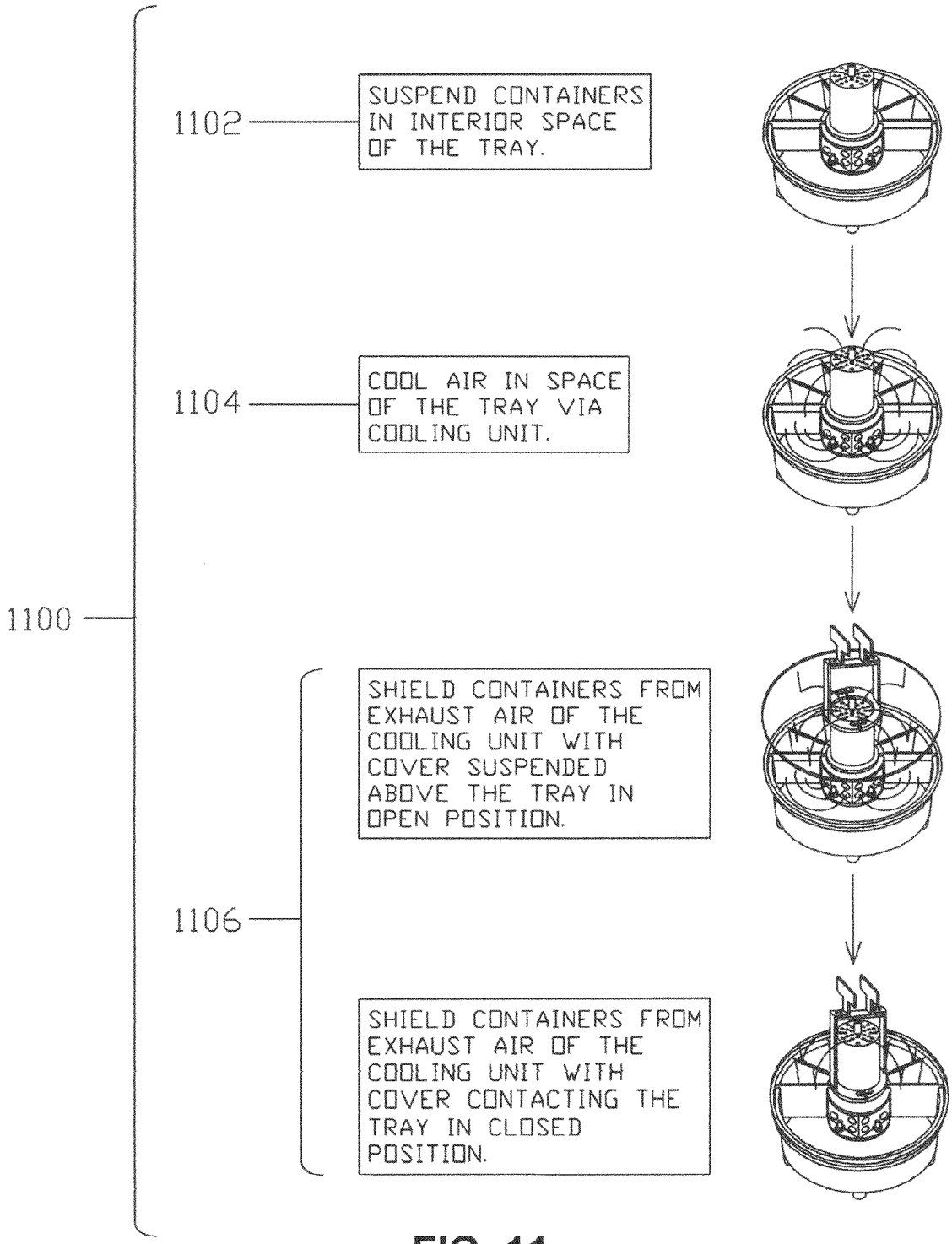
FIG. 11 is a flow chart of a method according to an embodiment of the present invention.

The upper portion 240 of the cooling unit 200 may extend axially along a longitudinal axis of the cooling unit 200. To enhance the aesthetic appearance of the apparatus, a housing 250 may be optionally provided to enclose the upper portion, as illustrated in FIG. 5F and FIG. 11, The housing 250 may be configured to facilitate selective movement of the tray cover 400 along the longitudinal axis of the cooling unit 200. To this end, the outer surface of the housing 250 may be smooth. Additionally or alternatively, the housing may include grooves or other structure to guide the tray cover 400. The housing 250 may include holes to provide air flow to the cooling unit and to allow warm air to exhaust the apparatus. The housing 250 may be made of plastic or similar material that may provide transparency to light to allow illuminating of the tray via lighting element, such as, by way of non limiting example, light bulbs, mounted on the upper portion 240 of the cooling unit 200. Referring to FIG. 5D, a stepped formation 260 may extend around the perimeter of the base of the housing 250. The stepped formation 260 may include an upper ledge or step 263 and a lower ledge or step 266. The upper and the lower ledges 263, 266 may be horizontal and may be substantially smooth. As illustrated in FIG. 5B and will be explained in detail below, when the tray cover 400 is in the closed position, it may be seated on the smooth, horizontal surface of upper ledge 263. The interface between the tray cover 400 and the upper ledge 263 may be a sealing one. As illustrated in FIG. 3C and will be explained in more detail below, a portion of each food container 300 may rest on the horizontal surface of the lower ledge 266. The dimensions and configuration of the stepped formation 260 may vary. The top most side of each retained food container 300 may be held at or below the level of the upper ledge 263.

Figure 5E:
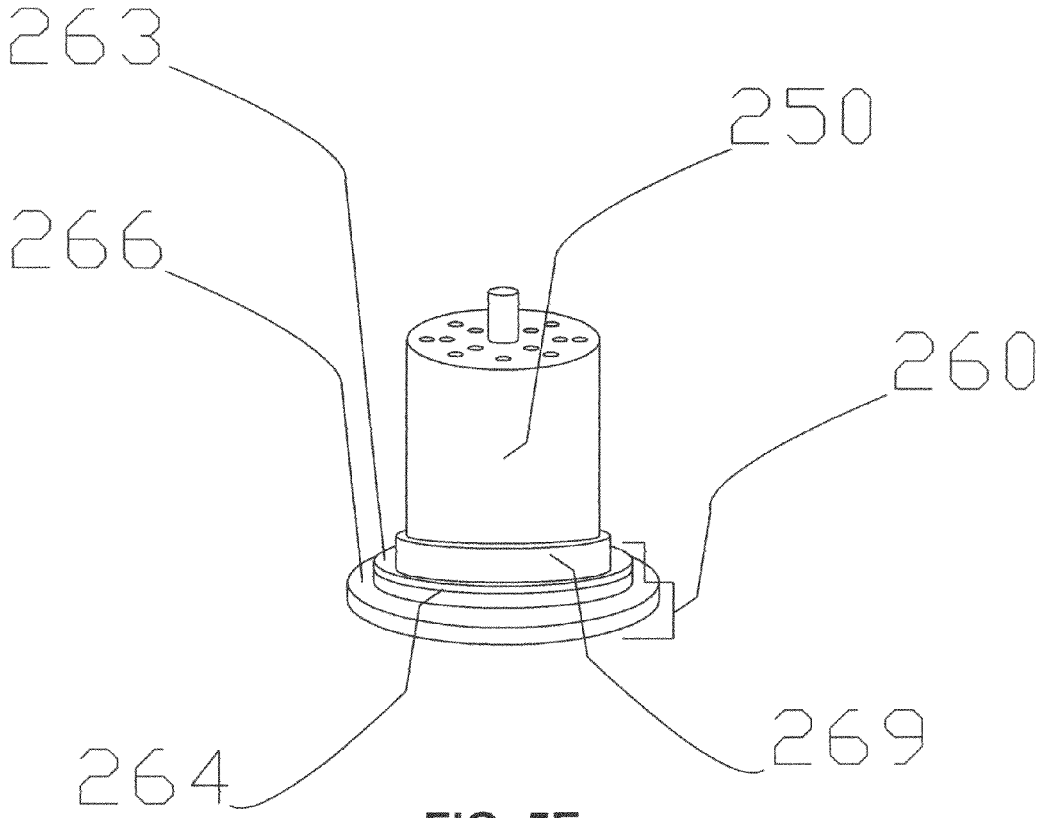
Figure 5F:
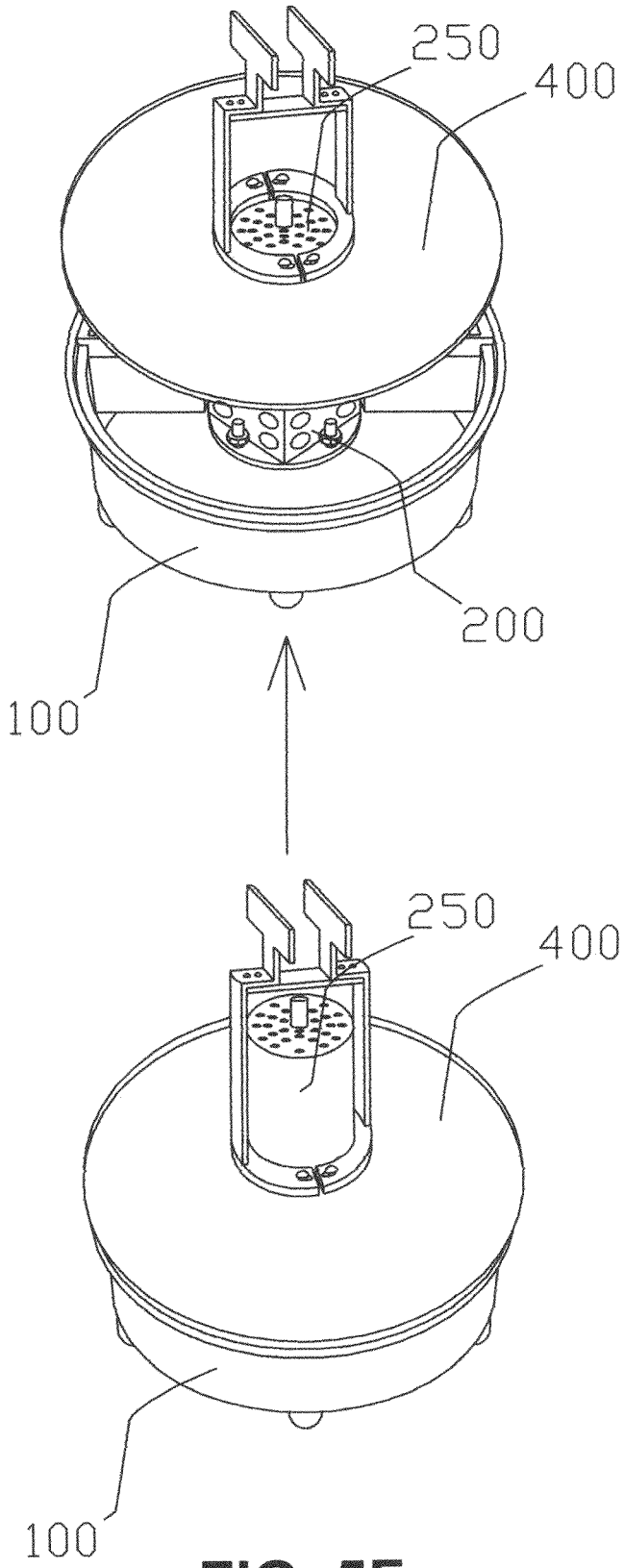

Alternatively, as illustrated by FIG. 5B, and FIG. 5E, the stepped formation 260 may include upper and lower ledges 263, 266 along with a perimeter ridge 269 extending above the upper ledge. As illustrated in FIG. 5B. In this configuration, the tray cover 400 may seat on the upper ledge 263 and within the perimeter ridge 269. This configuration may result in an increased seal between the tray cover 400 and the base of the housing 250. Additionally, this alternative configuration may promote a generally aesthetic appearance, since the edge of the tray cover 400 may not be not visible when the tray cover 400 is in the closed position.

Additionally or alternatively, as illustrated in FIG. 5D, 5E, and FIG. 3D regardless of the configuration of the stepped formation 260, a gasket 264 may be provided on the upper ledge 263 to facilitate the sealing contact between the tray cover 400 and the upper ledge 263, when the tray cover 400 is in the closed position.

Figure 3E:
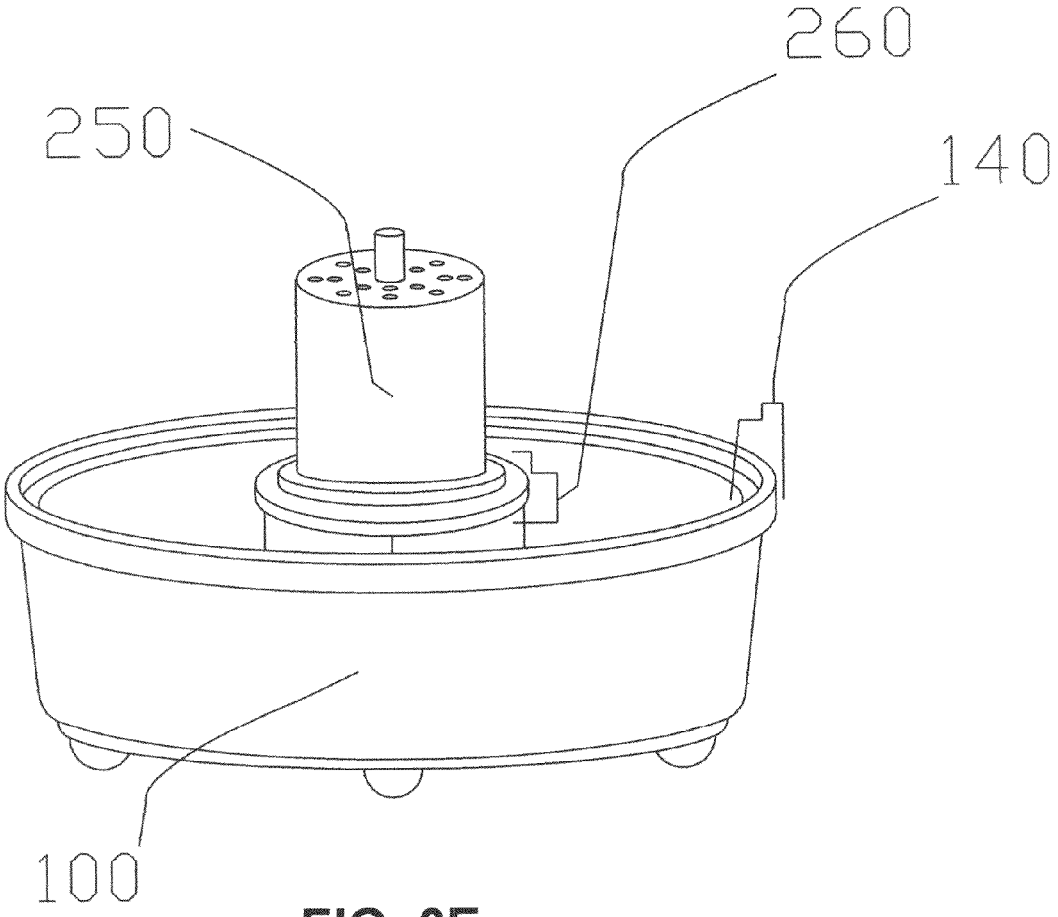

Additionally or alternatively, as illustrated in FIG. 3E, the configurations of the stepped formations 260 of the base of the housing and the stepped formation 140 of the tray, may compliment each other. Specifically, the stepped formation 260 of the base of the housing may mirror the stepped formation 140 of the tray.

In operation, as illustrated in FIG. 5C and FIG. 11, the cooling unit 200 may cool air in the interior of the tray 100. During the cooling process, warm exhaust may be generated. The cooling unit 200 may expel this warm exhaust air from the uppermost part of the upper portion 240, distal from the tray 100.

The Food Containers

Figure 7A:
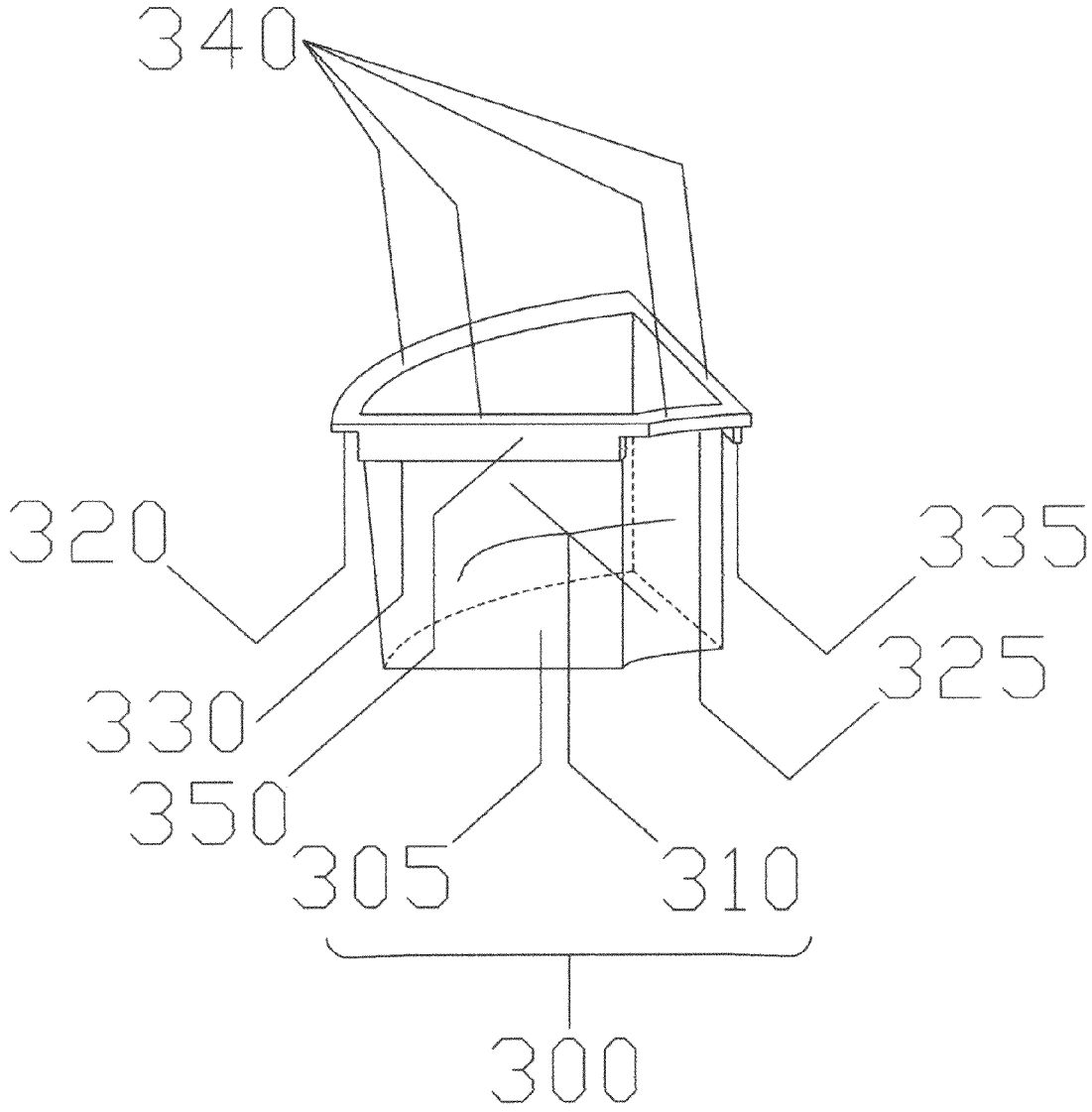
FIGS. 7A-7C, are various perspective views of the food containers according to the first embodiment.
Figure 7B:
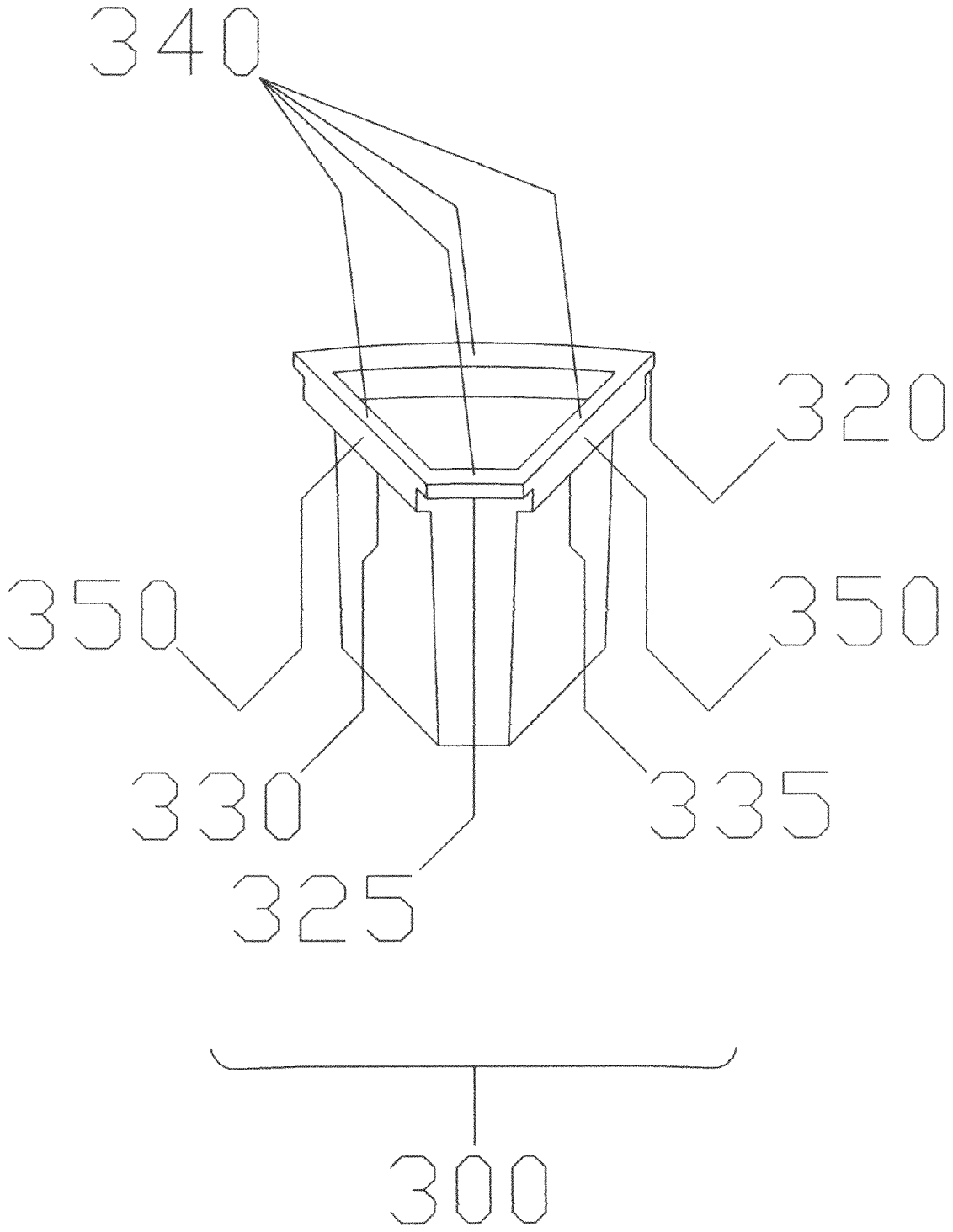

Referring to FIGS. 7A-7B, each of the food containers 300 may include a bottom 305 and sidewalls 310 that may collectively define an interior space. The top of each container 300 may be open to facilitate adding and removal of items from the container.

The container 300 may include a flange 340 that may extend around the perimeter of the open top of the food container. As illustrated in FIG. 3C, The flange 340 may be dimensioned such that portions at two opposing sides 320, 325 of the food container 300 may rest on the respective lower ledges 146, 266 of the tray and the base of the housing. The flange may either be integrally formed with the food container or attached to the container in a conventional manner.

At opposing sides 330, 335 of the food containers that may not rest on the ledges, may be sealing structures 350. The sealing structures 350 may extend downward from the flange 340 in a direction toward the bottom of the food container 300.

Figure 7C:
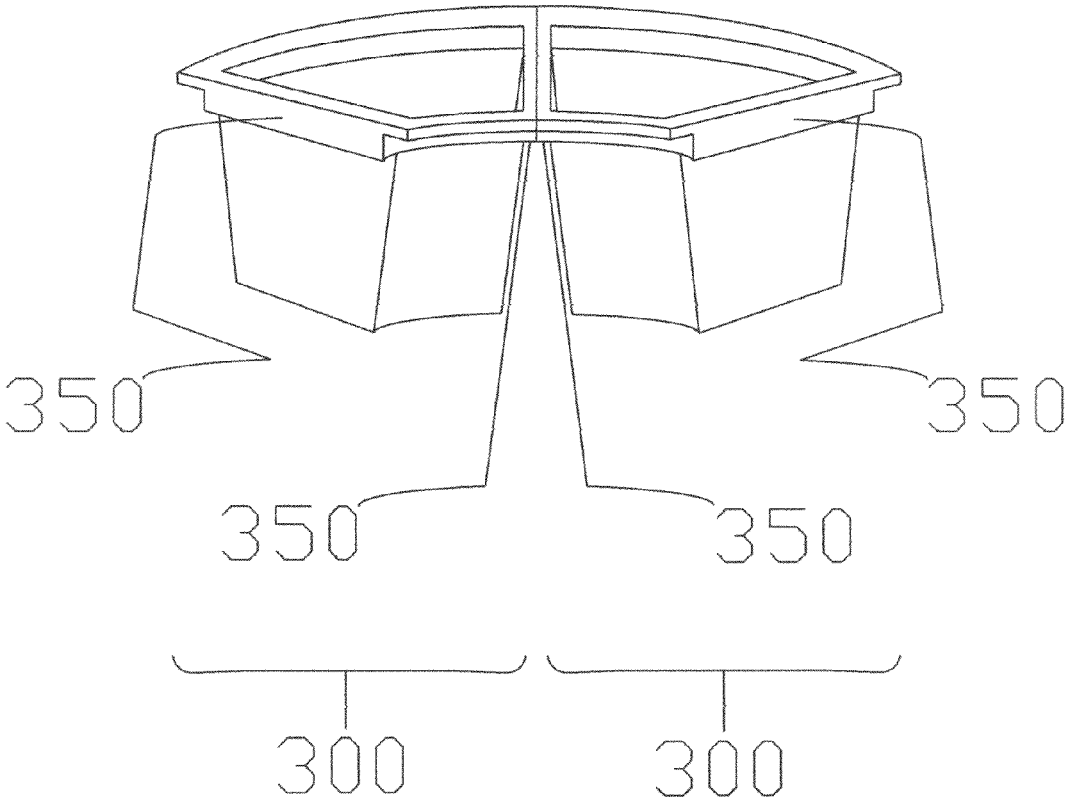

Referring to FIG. 7C, there are illustrated two food containers 300 in a side-by-side configuration as they would be found in the tray 100. The respective sealing structures 350 of the food containers may cooperate with each other, when they are suspended in the tray. By way of a non-limiting example, the sealing structures 350 may abut each other, as illustrated. The dimensions and configuration of the sealing structures 350 may vary. The sealing structures 350 may cooperate with sealing structures of adjoining food containers 300 to prevent cooled air from flowing out of the tray at the point of contact between the food containers when they are suspended in the tray 100.

The configuration and dimensions of each food container 300 may be varied. As illustrated in FIG. 3C, The containers 300 may fit in and may be accepted by the tray 100. Non-limiting examples of the shapes of the food containers 300 include square and wedge shapes. Each of the plurality of containers 300 may either share a shape or be of different complimentary shapes. Also, the depth of the food containers may vary. The container may hold a desired amount of food and is spaced from the bottom 110 of the tray 100 when the container is suspended in the tray.

Additionally or alternatively, each of the containers 300 may be dropped into the tray 100 and suspended within the tray. Each container may rest on the ledge of the tray and the ledge of the base of the housing of the cooling unit.

The Tray Cover

Figure 9A:
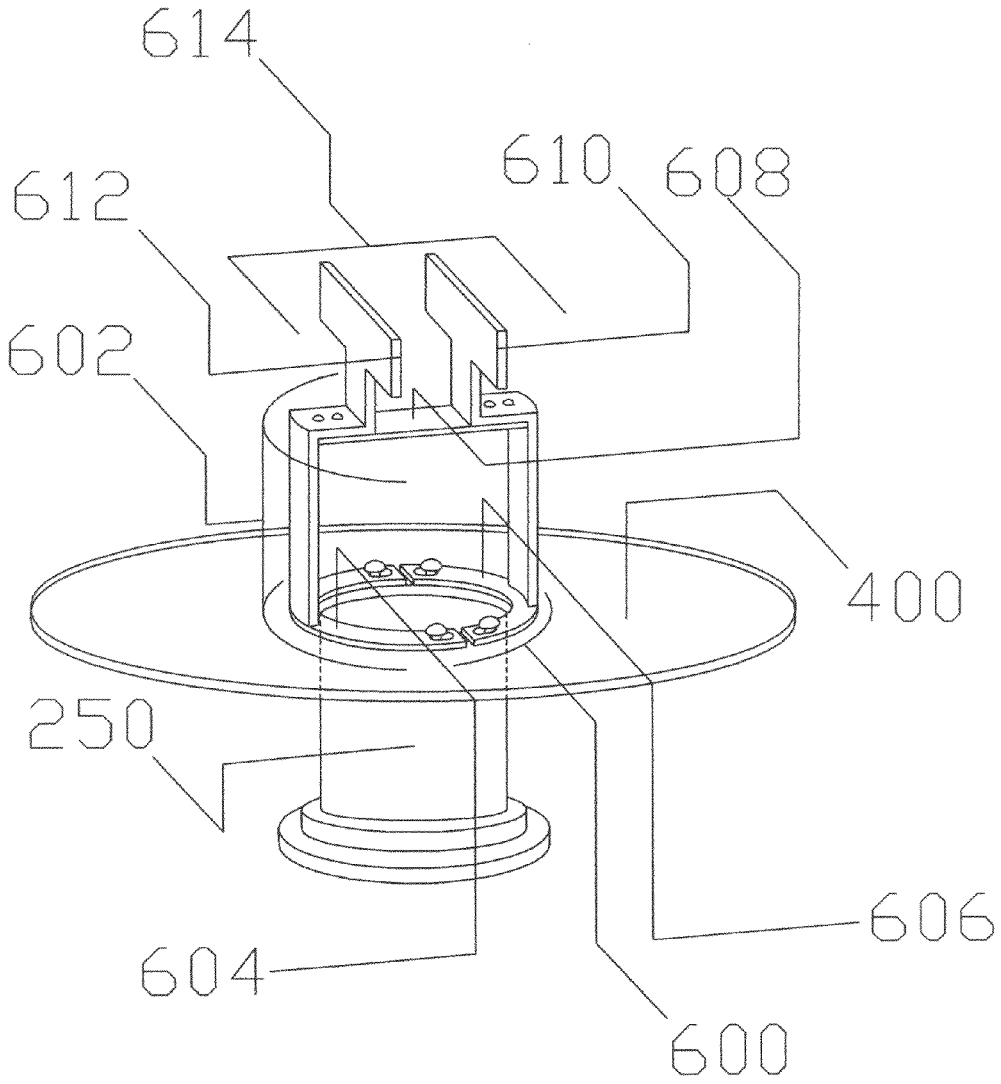
FIGS. 9A-9C are various perspective views of the tray cover according to the first embodiment.
Figure 9B:
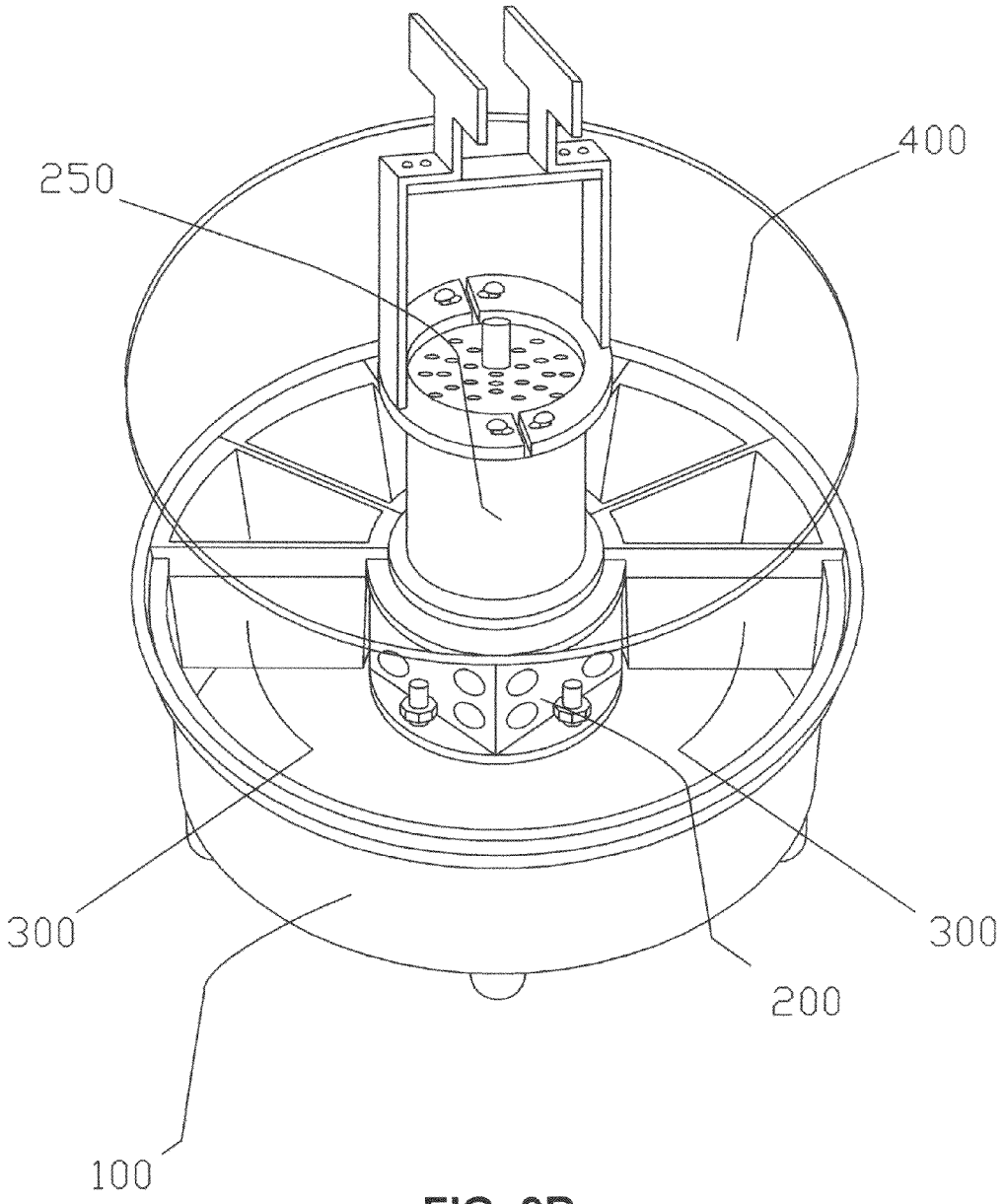

Referring again to FIG. 1A, 1B, and to FIG. 9B, there is shown tray cover 400. The tray cover 400 may be generally disk-like or plate shaped. The tray cover 400 may sealingly cover the tray 100 when the tray cover is in the closed position. The dimensions and configuration of the tray cover 400 may vary. By way of a non-limiting example, when the tray 100 is round as it is illustrated in FIG. 9B, the circumference of the tray cover 400 may at least match that of the tray 100.

As illustrated in FIG. 9A, The tray cover 400 may be movably attached to the housing 250 of the cooling unit 200 by a tray cover attaching arrangement 602, the tray cover attaching arrangement 602 may include, by way of non-limiting examples, resilient or biased arrangements. For example, the attaching arrangement 602 may be a flexible ring 600 divided in two halves 604, 606. The diameter of the inner wall of the halves 604, 606 may be approximately equal to the diameter of the outer wall of the housing 250 of the cooling unit. The inner walls of the halves 604, 606 may clamp around the outer wall of the housing 250 of the cooling unit. The attaching arrangement 602 may include a handle 614. Clamping contact may be created by linking the two halves 604, 606 with a spring strip 608 centrally placed above the housing 250 of the cooling unit through the handle 614. The spring strip 608 may be formed any appropriate material.

By way of non-limiting examples, the spring strip 608 may be formed of metal or plastic. A space between ends 610, 612 of the handle 614 may be maintained to allow flexing of the spring strip 608. When the ends 610, 612 of the handle 614 are forced together, the two halves 604, 606 may spread apart releasing their clamping contact on the housing 250 of the cooling unit. The shape and dimensions of the handle 614 may be varied. The handle 614 may be configured to facilitate selective movement of the tray cover 400 and to release clamping of the cover attaching arrangement 602.

Figure 9C:
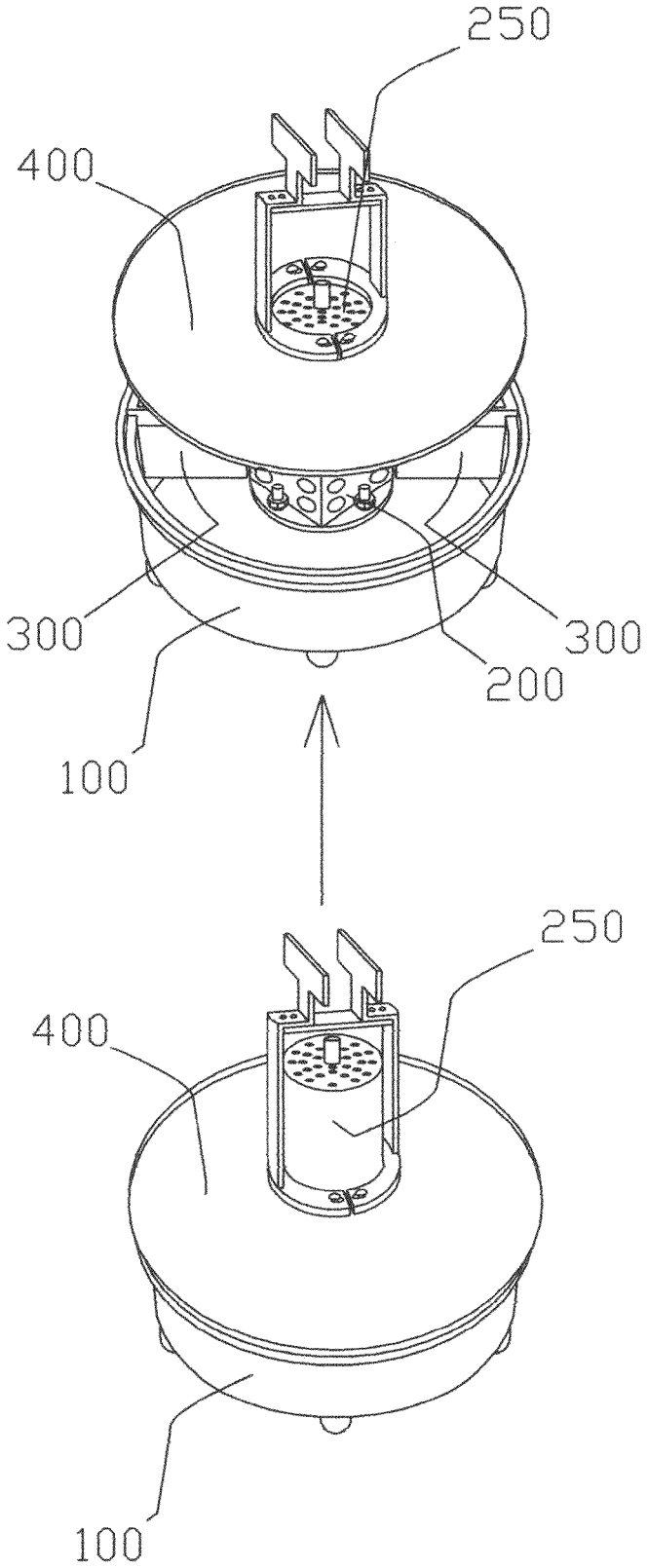

As illustrated in FIG. 9C and FIG. 11, The tray cover 400 may be movable along the longitudinal axis of the housing 250 of the cooling unit 200 from a closed position at which the tray cover 400 may sealingly contact the circumferential area of the tray 100 to an open position that may permit access to items contained in the food containers 300. More specifically, as illustrated in FIG. 5B, in the closed position, the tray cover 400 may contact upper ledges 143, 263 of the tray 100 and the base of the housing 250 of the cooling unit, sealing the interior 120 of the tray from the top side.

As illustrated in FIG. 9B and FIG. 11, When the tray cover 400 is in an open position, it may be suspended above the tray 100 at the cooling unit housing 250. In this position, the tray cover may serve at least two functions. First, the tray cover 400 may serve as a so called "sneeze guard" that may prevent contamination of the items in the food containers 300. Second, the tray cover 400 may serve as a barrier that may keep the warm exhaust from returning to the cooled food containers 300.

Second Embodiment

Figure 2A:
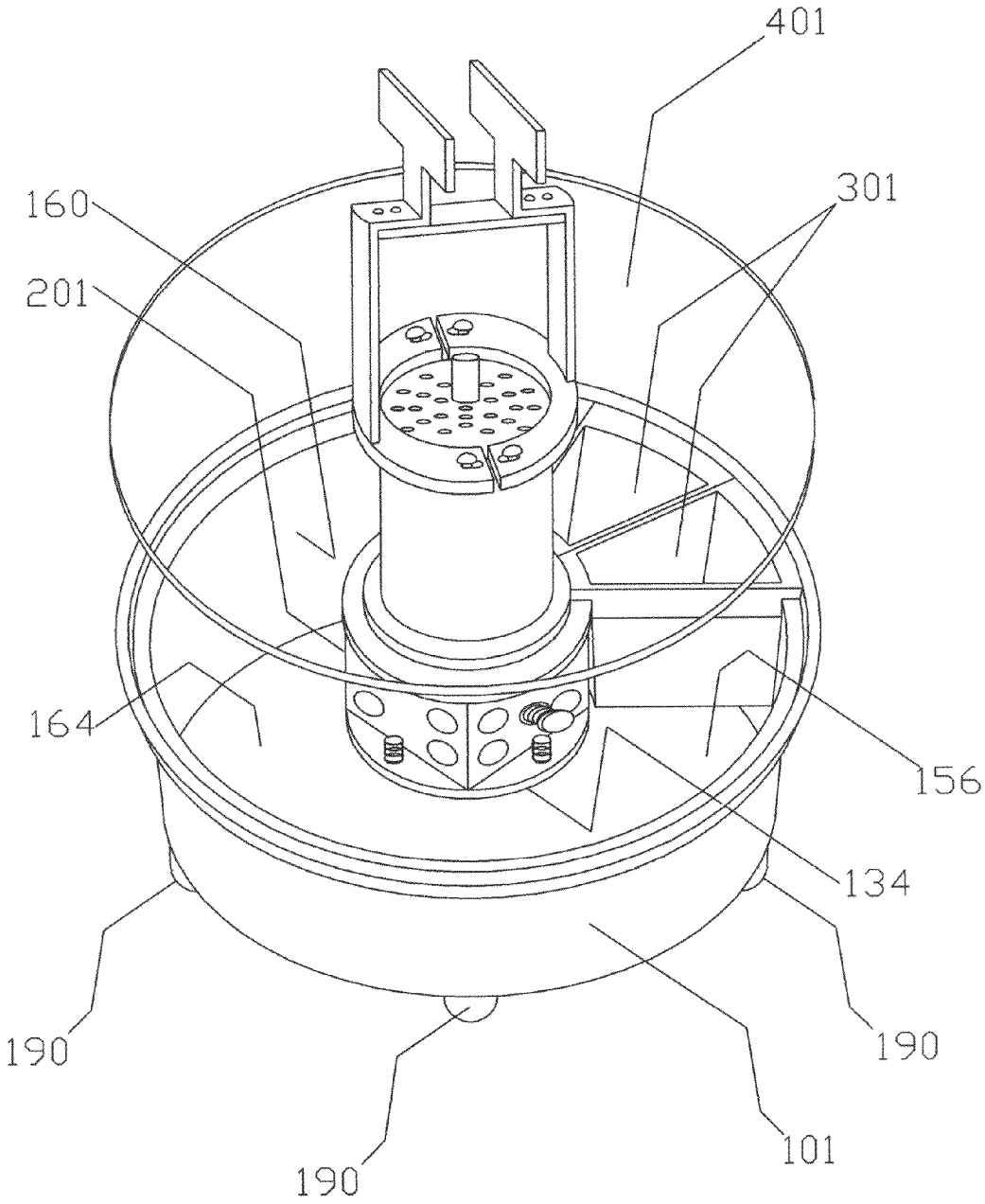
FIG. 2A-2B are exploded perspective views of an apparatus according to a second embodiment of the present invention.
Figure 2B:
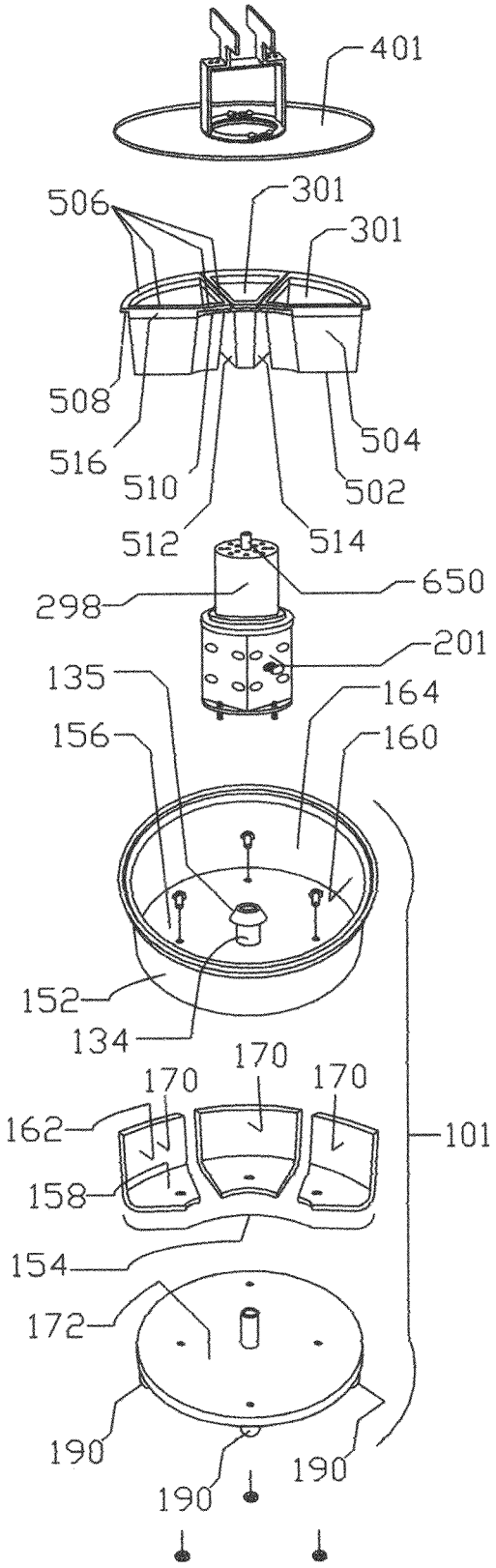

Referring to FIG. 2A, and FIG. 2B, there is shown an exploded perspective view of an apparatus according to another embodiment of the present invention. The apparatus may include a tray 101, a cooling unit 201, a plurality of food containers 301, and a tray cover 401. The cooling unit 201 may be removably mounted to the tray 101. The plurality of food containers 301 may be accepted by and independently suspended in the tray 101.

The Tray

Referring to FIG. 2A, and FIG. 2B, the tray 101 may be a receptacle for the food containers 301. The tray 101 may include an inner shell 152 and an outer shell 154. The inner shell 152 may fit within the outer shell 154. The inner shell 152 and the outer shell 154 may each include a bottom 156, 158, and at least one sidewall 160, 162, which may collectively define an interior or space 164. As will be explained in detail below, the cooling unit 201 may cool the interior 164. The number of sidewalls may depend on the shape of the tray, which may vary. For example, when the tray is generally circular, the number of sidewalls may be one.

The dimensions and configurations of the tray 101 may vary. For example, the depth of the tray may be varied. The bottom 156 of the inner shell 152 is spaced from the food containers 301 when they are received in the tray 101. Also, the tray 101 may be any shape that suitably accepts and receives the food containers 301. Non-limiting examples of the shape of the tray 101 may include a circle, an oval, a square, a triangle, and a rectangle.

The inner shell 152 and the outer shell 154 may be of any material that provides sufficient insulation properties, either individually, or when combined (i.e., one or both of the inner and outer shells may provide sufficient insulation properties). By way of a non-limiting example, the inner shell 152 may be formed of 3 mm thick plastic, and the outer shell 154 may be formed of 7 mm thick ceramic.

The outer shell 154 may include multiple portions. By way of a non-limiting example, outer shell 154 may include four portions 170 (only three shown). A multi-portion ceramic outer shell may be more desirable (e.g., less expensive to ship) than a singular ceramic outer shell. Referring to FIG. 4C, in a modification to the second embodiment, the tray 101 may include an outer shell 154 formed of ceramic sidewalls 704 and an insulated bottom 702. The insulated bottom 702 may be formed of Styrofoam.

Referring back to FIGS. 2B and 4A, the tray 101 may include a base 172. The base 172 may be removably mounted to the four portions 170, which may be removably mounted to the inner shell 152 using an appropriate fastener. By way of a non-limiting example, bolts 180 may be inserted into holes in the bottom 156 of the inner shell 152 down through holes in the bottom 158 of the outer shell 154 (the four portions 170) and into holes in the base 172 and into corresponding nuts 182. As shown in FIG. 4B, a base may be omitted, and bolts 180 may be inserted into holes in the bottom 156 of the inner shell 152 down through holes in the bottom 158 of the outer shell 154 (the four portions 170) and into corresponding nuts 182.

Figure 6A:
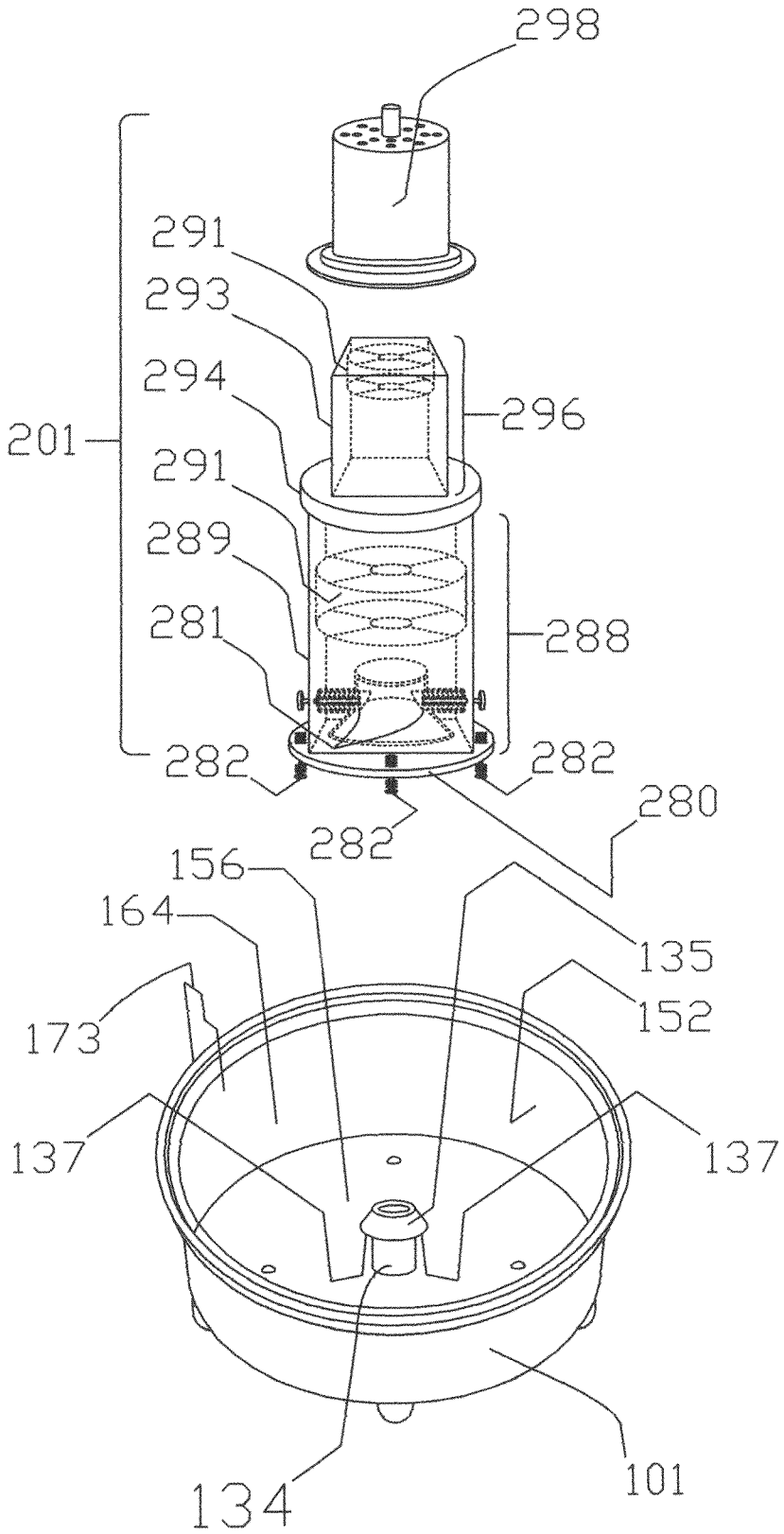
FIGS. 6A-6C, and 6F are exploded perspective views of a cooling unit according to the second embodiment.

Referring to FIG. 6A The tray 101 may include a mounting arrangement 134 extending from the inside bottom 156 of the inner shell 152 of the tray 101. The mounting arrangement 134 may removably interconnect the cooling unit 201 to the tray 101. The mounting arrangement may include, by way of non-limiting example, a cone-shaped platform 135 adapted to cooperate with complimentary mounting structures on the cooling unit 201, as will be described below. The cone-shaped platform 135 may be either integrally formed with or attached to the inside bottom 156 of the inner shell 152 of the tray 101. Dimensions and configuration (e.g., shape) of the cone-shaped platform 135 may vary. The mounting arrangement may mount the cooling unit 201 in a spaced manner such that an adequate flow of air is available to the cooling unit. The mounting arrangement may mount the cooling unit 201 in a spaced manner such that an opening in the tray 101 provided for receiving a power cord to power the cooling unit is sealed. The mounting arrangement 134 may be located at the substantial center of the bottom 156 of the tray 101.

As noted above and as illustrated in FIG. 4A-4C, the tray 101 may include a base 172. The base 172 may include a plurality of legs 190 extending from bottom of base 172 toward the surface on which the apparatus rests. The legs may be either integrally formed with or attached to the base. The number and arrangement of the legs 190 may vary. The number of legs may be at least three so as to define a plane. The configuration of the legs may also be varied. For example, as shown in FIG. 4B, legs 190 may extend from the outside bottom of the inner shell 152 through holes in the outer shell 154.

Figure 4A:
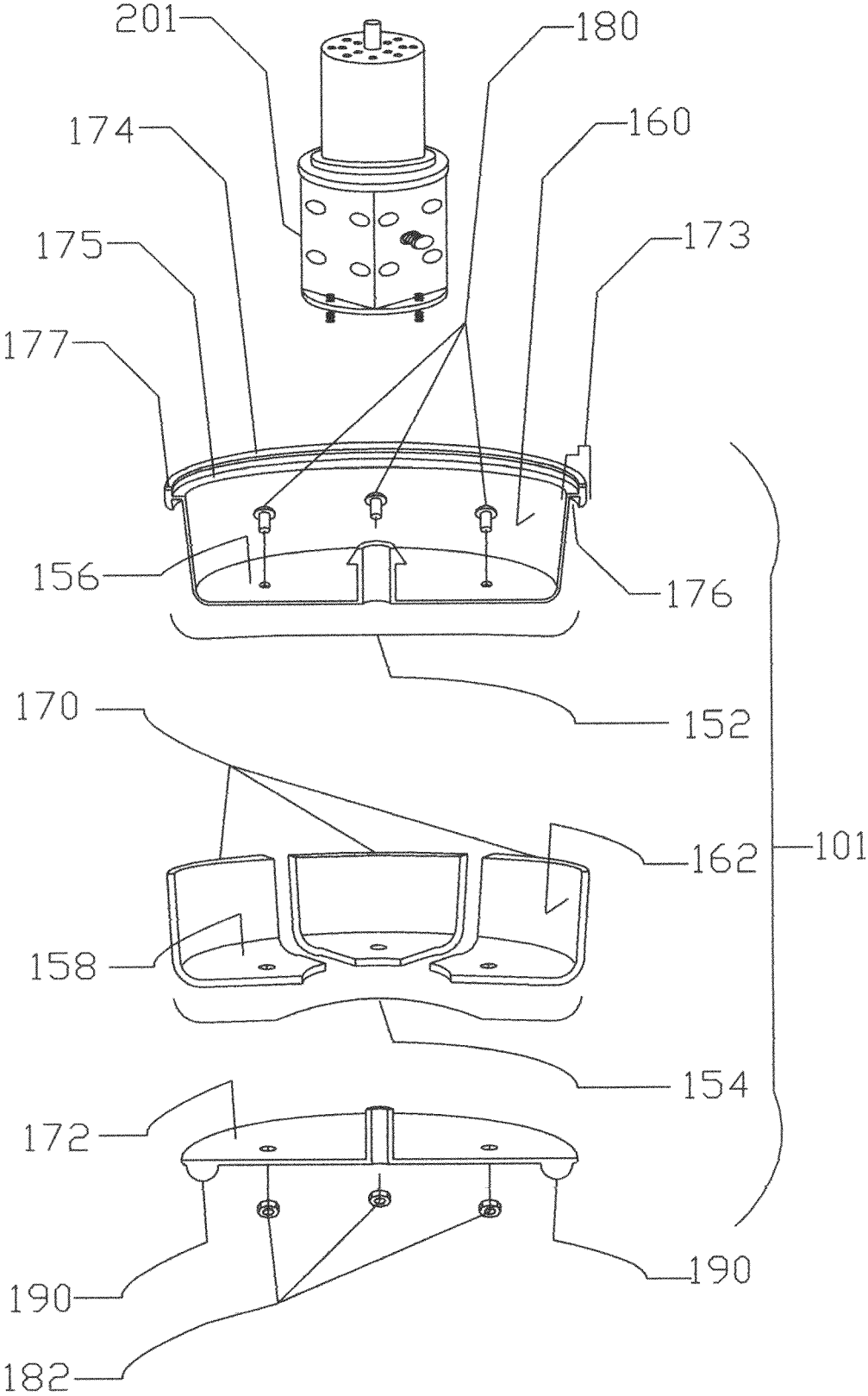
FIG. 4A-4B are section views of alternative configurations of a tray according to the second embodiment.
Figure 4B:
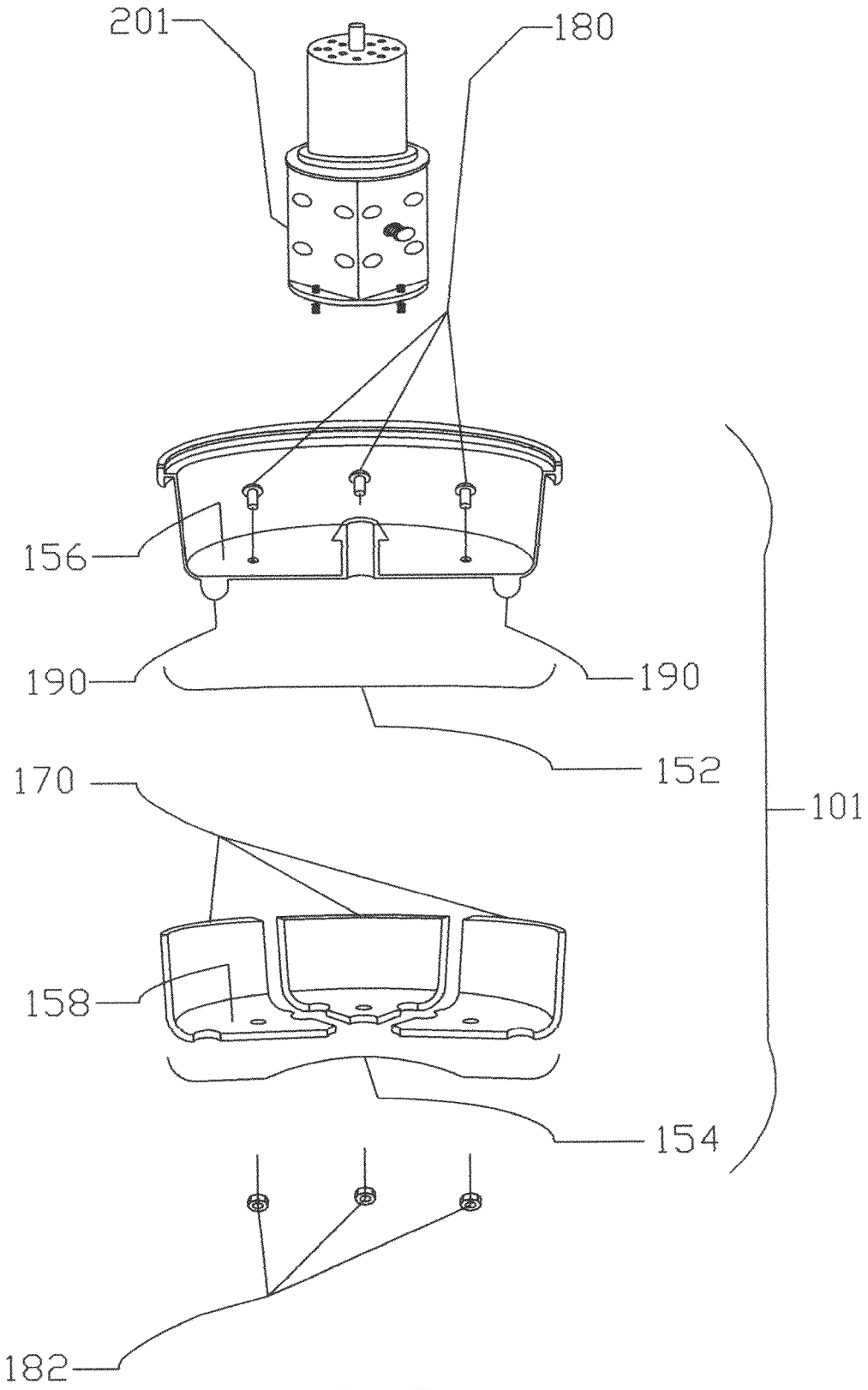
Figure 4C:
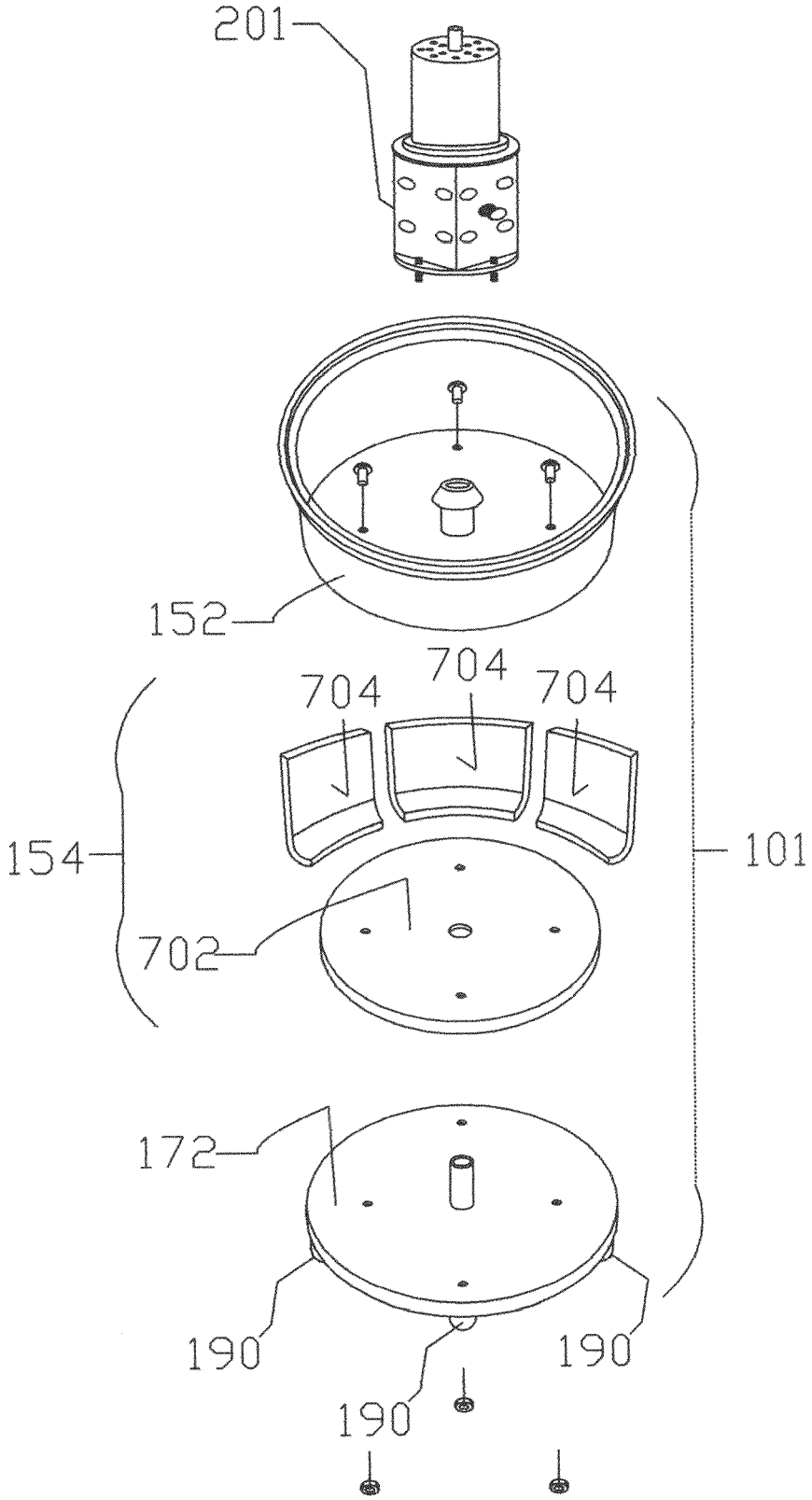
FIG. 4C is an exploded perspective view of an alternative configuration of a tray according to the second embodiment.
Figure 4D:
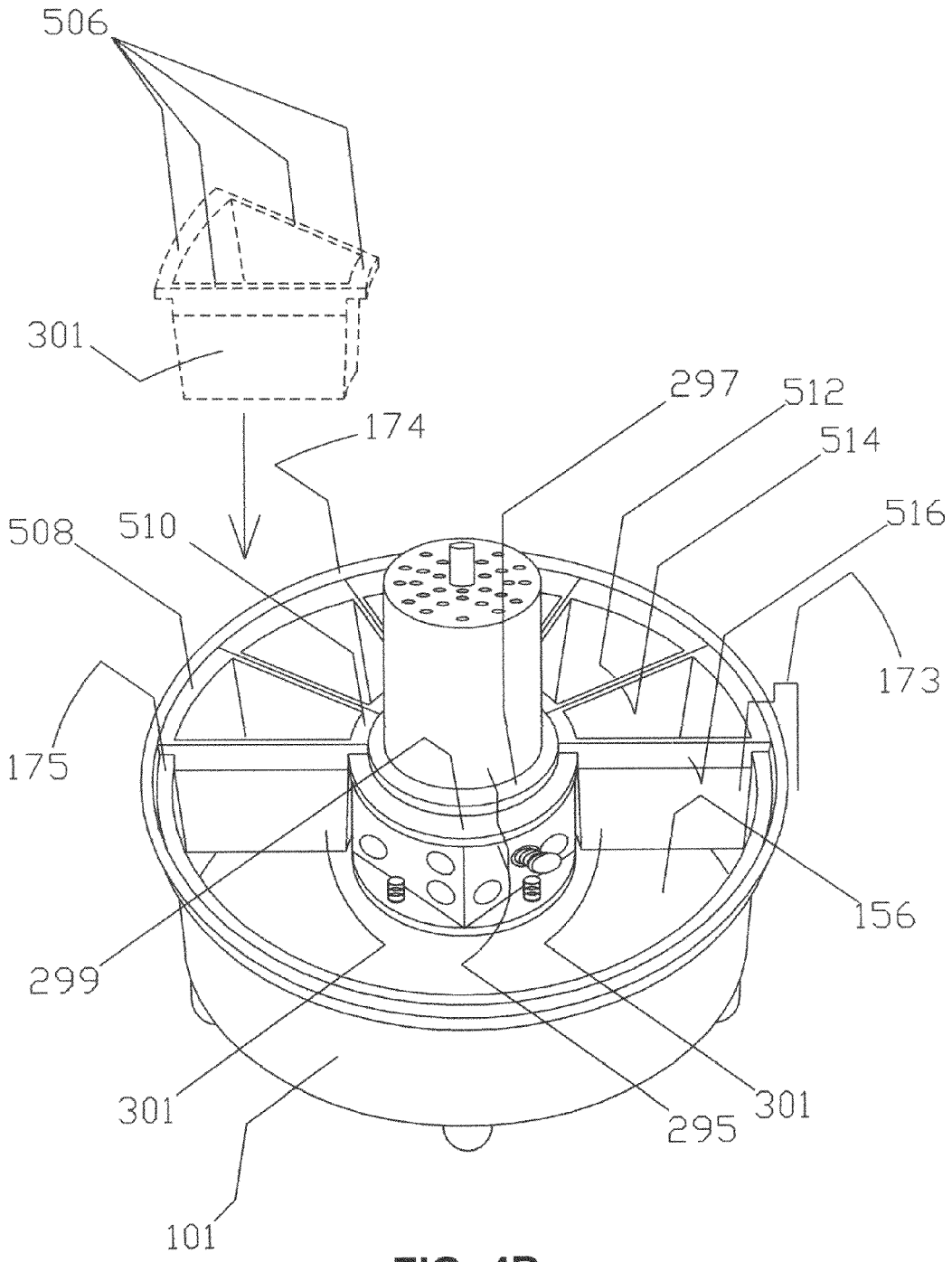
FIG. 4D-4F are various perspective views of a tray according to the second embodiment.
Figure 4E:
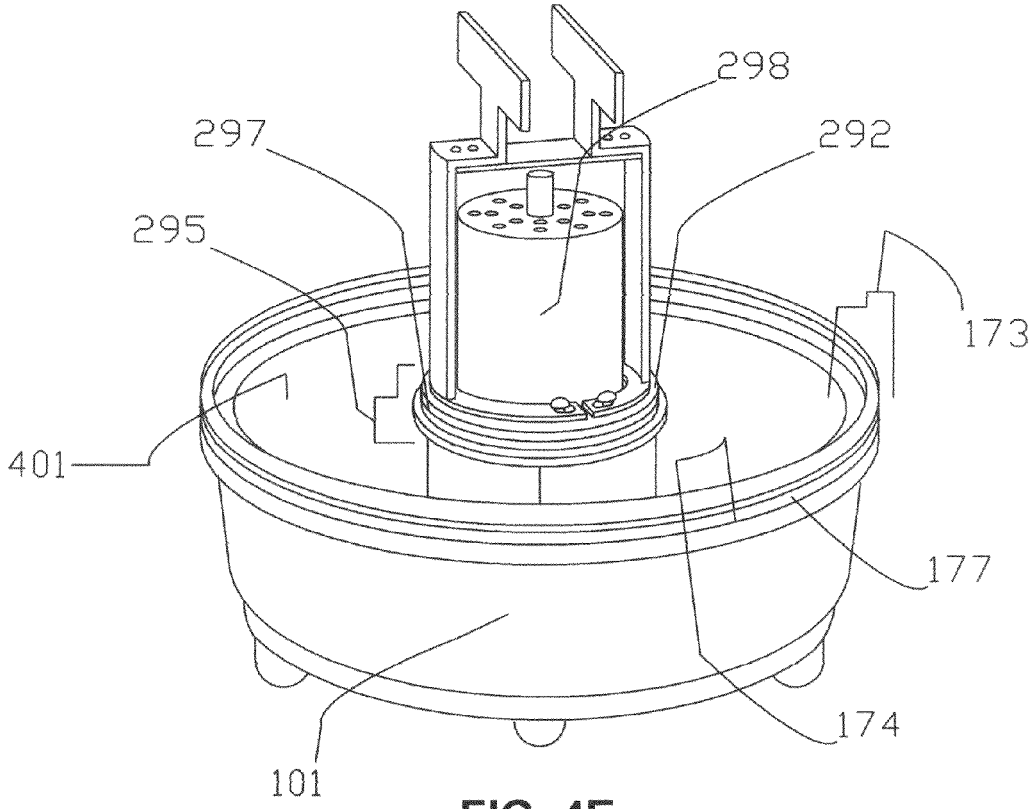

Referring to FIG. 4A, the tray 101 may include a stepped formation 173 at the top edge of the sidewall 160 of the inner shell 152 of the tray. This stepped formation 173 may extend around the perimeter of the tray 101. The stepped formation 173 may include an upper ledge or step 174 and a lower ledge or step 175. These upper and lower ledges may be horizontal and may be substantially smooth. As illustrated in FIG. 4E and will be explained in detail below, when the tray cover 401 is in the closed position, it may be seated on the smooth, horizontal surface of the upper ledge 174. The interface between the tray cover 401 and the upper ledge 174 may be a sealing one. As illustrated in FIG. 4D and will be explained in more detail below, a portion of each food container 301 may rest on the horizontal surface of the lower ledge 175 of the inner shell of the tray 101. The dimensions and configuration of the stepped formation 173 may vary. The top most side of each food container 301 may be held at or below the level of the upper ledge 174 of the inner shell of the tray 101.

Referring again to FIG. 4A, The stepped formation 173 may include an outer shell lip recess 176. The outer shell lip recess 176 may receive a portion of the sidewall 162 of the outer shell 154 when the inner shell 152 is within the outer shell 154.

Additionally or alternatively, as illustrated in FIG. 4A and FIG. 4E a gasket 177 may be provided on the upper ledge 174 to facilitate the sealing contact between the tray cover 401 and the upper ledge 174 of the tray, when the tray cover 401 is in the closed position.

The Cooling Unit

Referring to FIG. 6A, there is illustrated an exploded, perspective view of the cooling unit 201 and the tray 101. The cooling unit 201 may cool the air in the interior 164 (in an embodiment, the interior of the inner shell 152) and thus may cool items in the food containers 301 when they are received in the interior 164. The cooling unit may be freestanding and removably mounted to the inside bottom 156 of the inner shell 152 of the tray 101. The cooling unit 201 may be a thermoelectric cooling unit.

The cooling unit 201 may include, from the bottom of the cooling unit upwards (bottom to top as illustrated in FIG. 6A), a mounting portion 280, a lower portion 288, a plate 294, an upper portion 296, and a housing 298.

The mounting portion 280 may cooperate with the mounting arrangement 134 of the tray 101 to removably mount the cooling unit 201 to the substantial center of the tray 101. Thus, the mounting portion 280 has a configuration that may compliment that of the mounting arrangement 134. By way of non-limiting example, when the mounting arrangement includes a cone-shaped platform 135, the mounting portion 280 may include two or more spring-loaded mechanisms 281 fitting into locking cavities 137 under the cone-shaped platform 135. The mounting portion 280 may include three or more spring loaded feet 282 to provide upward force on the cooling unit 201 resulting in a firm engagement of the spring-loaded mechanisms 281 into the locking cavities 137.

The mounting portion 280 may be housed within a frame 289 constituting the lower portion 288. The frame 289 may be a cubic aluminum frame with circular holes therein. A fan 291 may also be housed within the frame 289. The frame 289 may serve as a basic support of the cooling unit 201 to enable it to be free standing. The frame 289 may serve as an extension of a heat sink that may be installed within the frame 289. The frame 289 may provide stability to handle the stresses caused by pulling and pushing on the tray cover 401, and the weight of the apparatus and any contents therein.

The plate 294 may be substantially disk-shaped and separate the upper portion 296 and the lower portion 288 of the cooling unit 201.

Figure 6B:
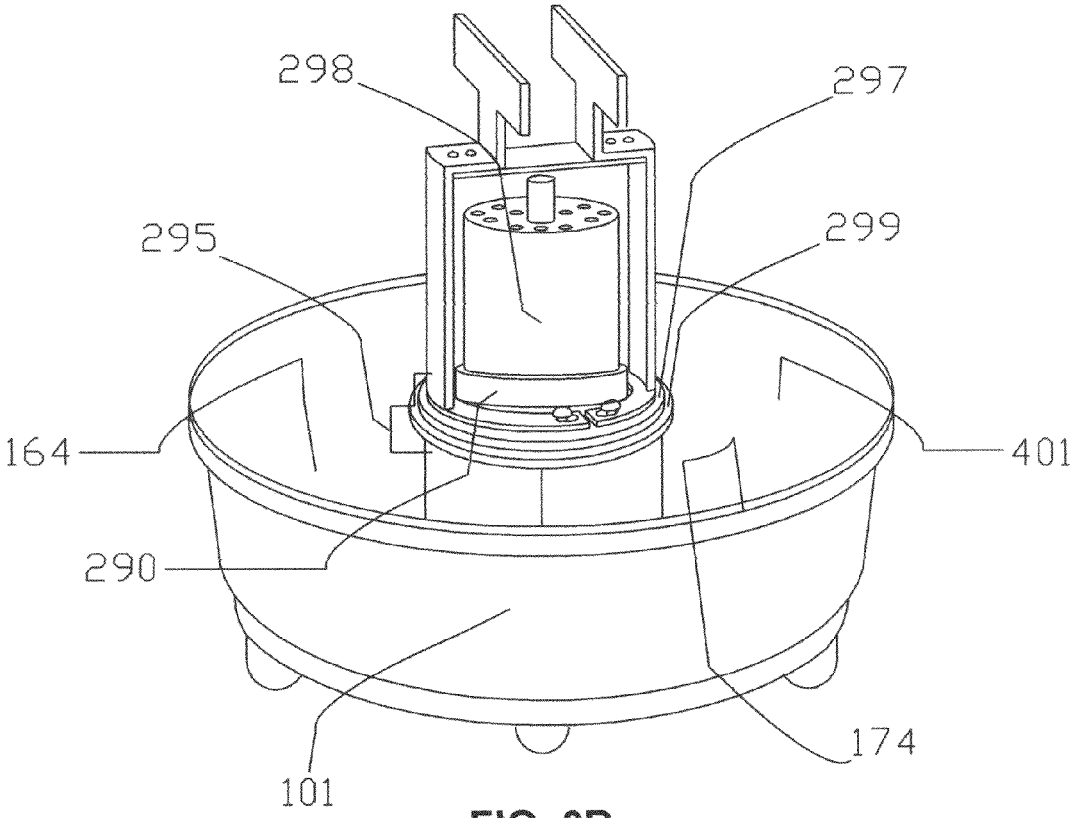
Figure 6C:
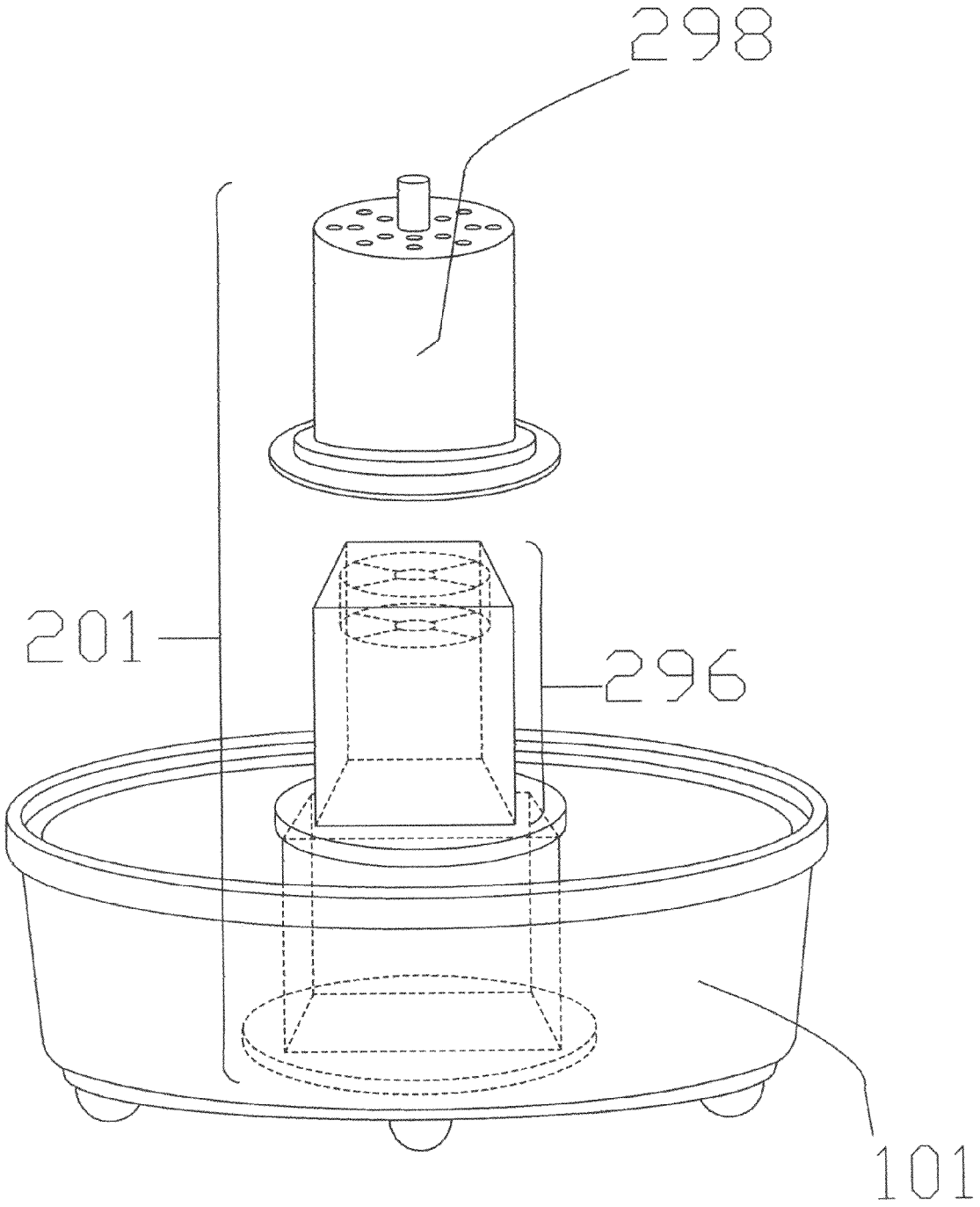
Figure 6D:
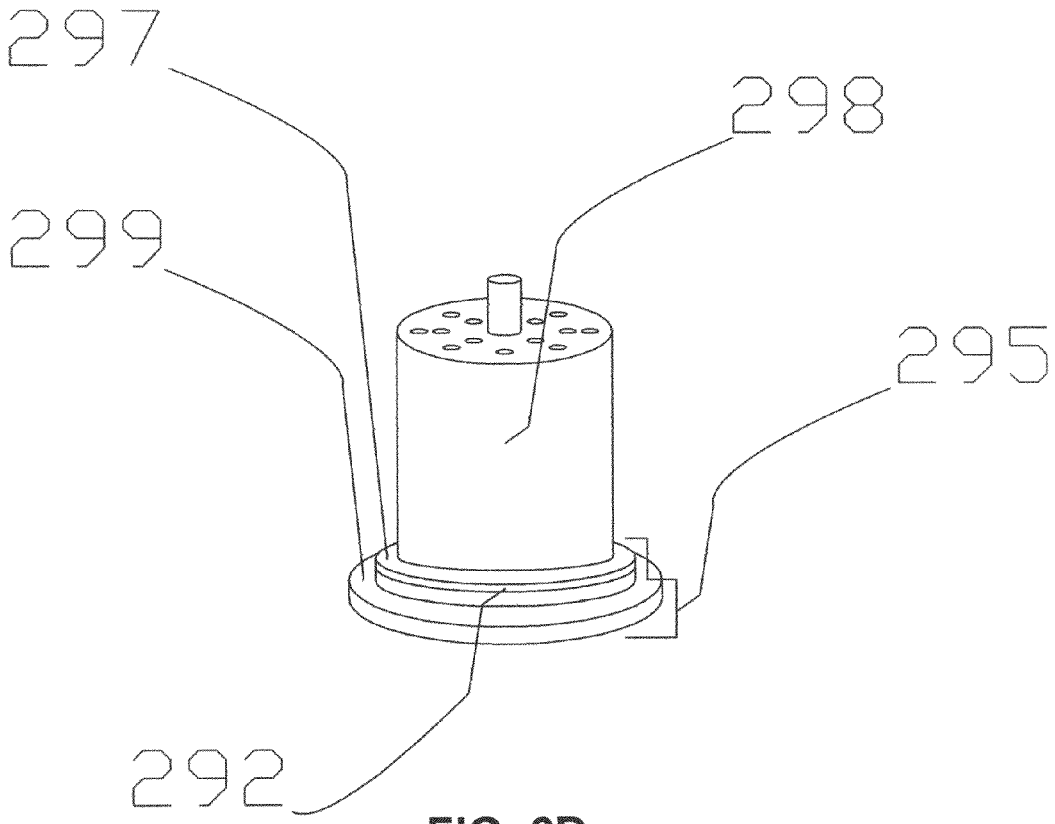
FIG. 6D-6E are perspective elevation views of alternative configurations of the stepped formation of the base of the housing of the cooling unit according to the second embodiment.

The upper portion 296 of the cooling unit 201 may extend axially along a longitudinal axis of the cooling unit 201. To enhance the aesthetic appearance of the apparatus, a housing 298 may be optionally provided to enclose the upper portion, as illustrated in FIG. 6F and FIG. 11, The housing 298 may be configured to facilitate selective movement of the tray cover 401 along the longitudinal axis of the cooling unit 201. To this end, the outer surface of the housing 298 may be smooth. Additionally or alternatively, the housing may include grooves or other structure to guide the tray cover 401. The housing 298 may include holes to provide air flow to the cooling unit and to allow warm air to exhaust the apparatus. The housing 298 may be made of plastic or similar material that may provide transparency to light to allow illuminating of the tray via lighting element, such as, by way of non limiting example, light bulbs, mounted on the upper portion 296 of the cooling unit 201. Referring to FIG. 6D, a stepped formation 295 may extend around the perimeter of the base of the housing 298. The stepped formation 295 may include an upper ledge or step 297 and a lower ledge or step 299. The upper and lower ledges 297, 299 may be horizontal and may be substantially smooth. As illustrated in FIG. 6B and will be explained in detail below, when the tray cover 401 is in the closed position, it may be seated on the smooth, horizontal surface of the upper ledge 297. The interface between the tray cover 401 and the upper ledge 297 may be a sealing one. As illustrated in FIG. 4D and will be explained in more detail below, a portion of each food container 301 may rest on the horizontal surface of the lower ledge 299. The dimensions and configuration of the stepped formation 295 may vary. The top most side of each retained food container 301 may be held at or below the level of the upper ledge 297.

Figure 6E:
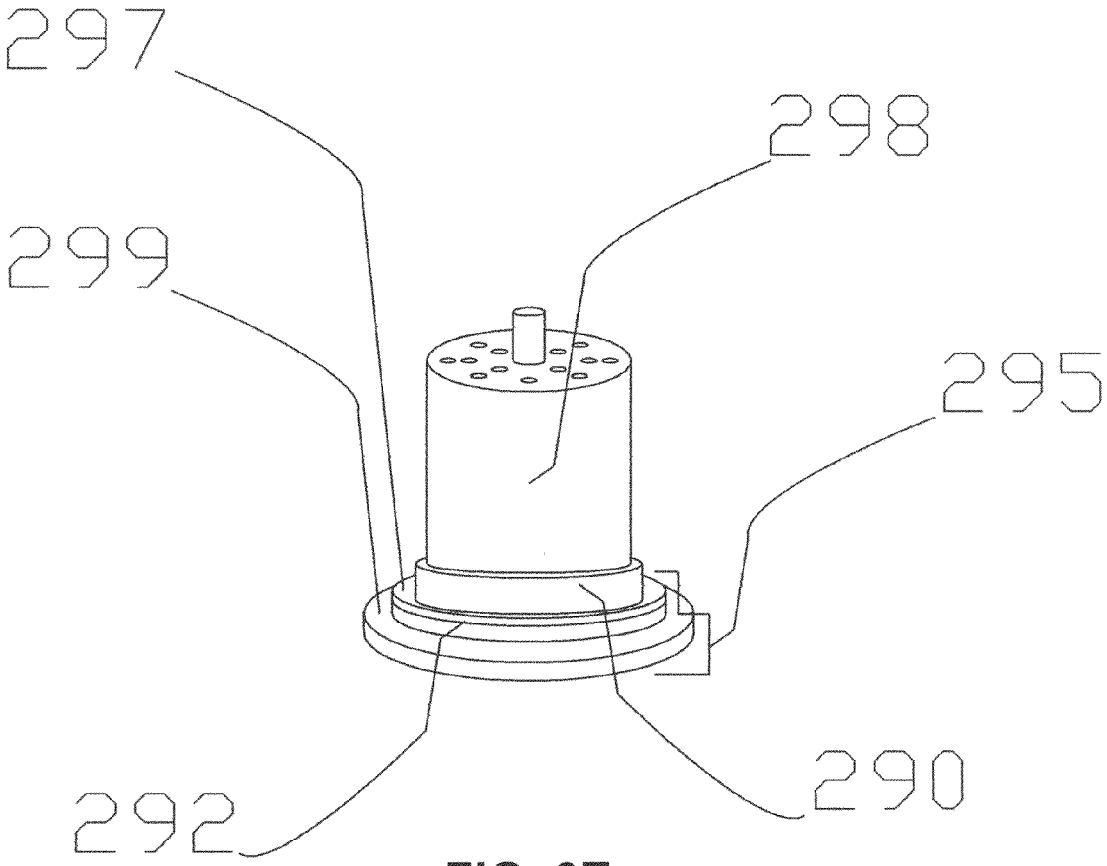
Figure 6F:
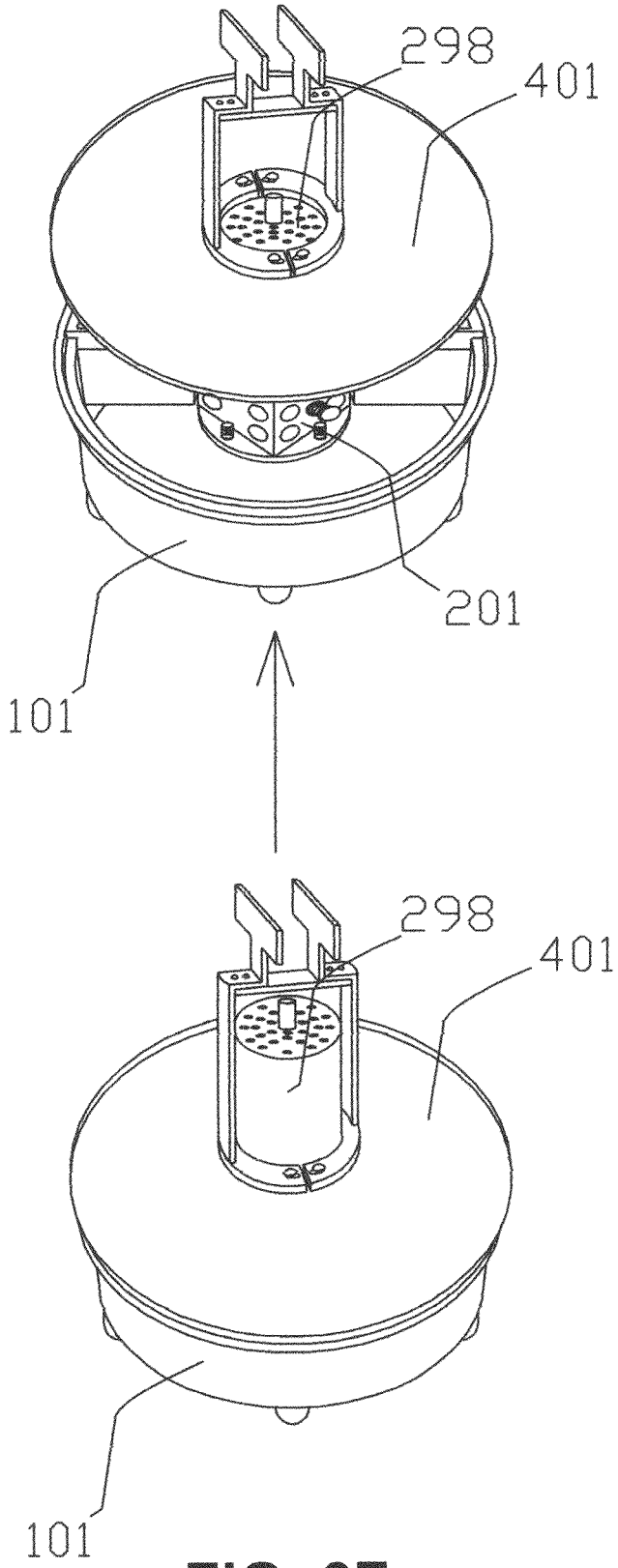

Alternatively, as illustrated in FIG. 6E, the stepped formation 295 may include upper and lower ledges 297, 299 along with a perimeter ridge 290 extending above the upper ledge 297. As illustrated in FIG. 6B, in this configuration, the tray cover 401 may seat on the upper ledge 297 and within the perimeter ridge 290. This configuration may result in an increased seal between the tray cover 401 and the base of the housing 298. Additionally, this alternative configuration may promote a generally aesthetic appearance, since the edge of the tray cover 401 may not be visible when the tray cover 401 is in the closed position.

Figure 4F:
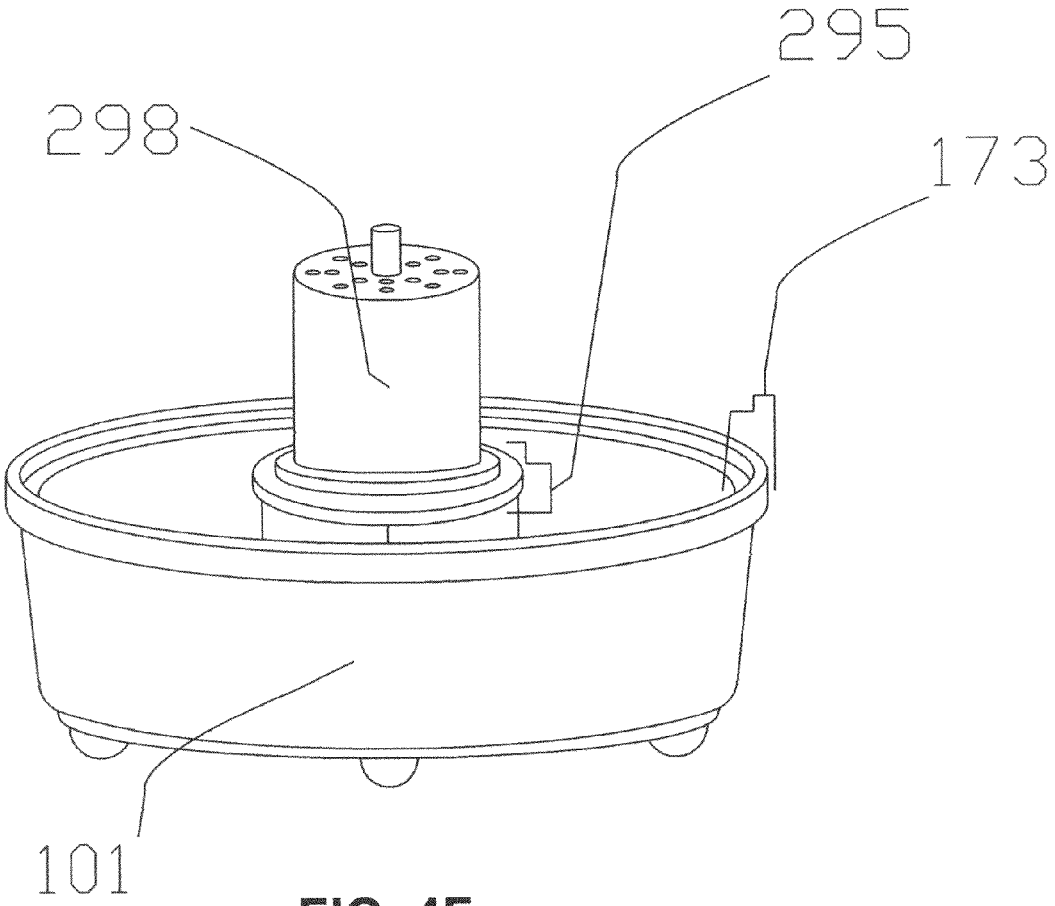

Additionally or alternatively, as illustrated in FIG. 4F, the configurations of the stepped formation 295 of the base of the housing and the stepped formation 173 of the tray may compliment each other. Specifically, the stepped formation 295 of the base of the housing may mirror the stepped formation 173 of the tray.

Referring again to FIG. 6A, A frame 293 may constitute the upper portion 296 of the cooling unit 201. The frame may be a cubic aluminum frame with circular holes therein. The frame may serve as an extension of a heat sink that may be installed within the frame. The frame may provide stability to handle the stresses caused by pulling and pushing on the tray cover 401, and the weight of the apparatus and any contents therein.

In operation, as illustrated in FIG. 6C and FIG. 11, the cooling unit 201 may cool air in the interior of the tray 101. During the cooling process, warm exhaust may be generated. The cooling unit 201 may expel this warm exhaust air from the uppermost part of the upper portion 296, distal from the tray 101.

Additionally or alternatively, as illustrated in FIG. 6D, 6E and FIG. 4E, regardless of the configuration of the stepped formation 295, a gasket 292 may be provided on the upper ledge 297 to facilitate the sealing contact between the tray cover 401 and the upper ledge 297, when the tray cover 401 is in the closed position.

The Food Containers

Figure 8A:
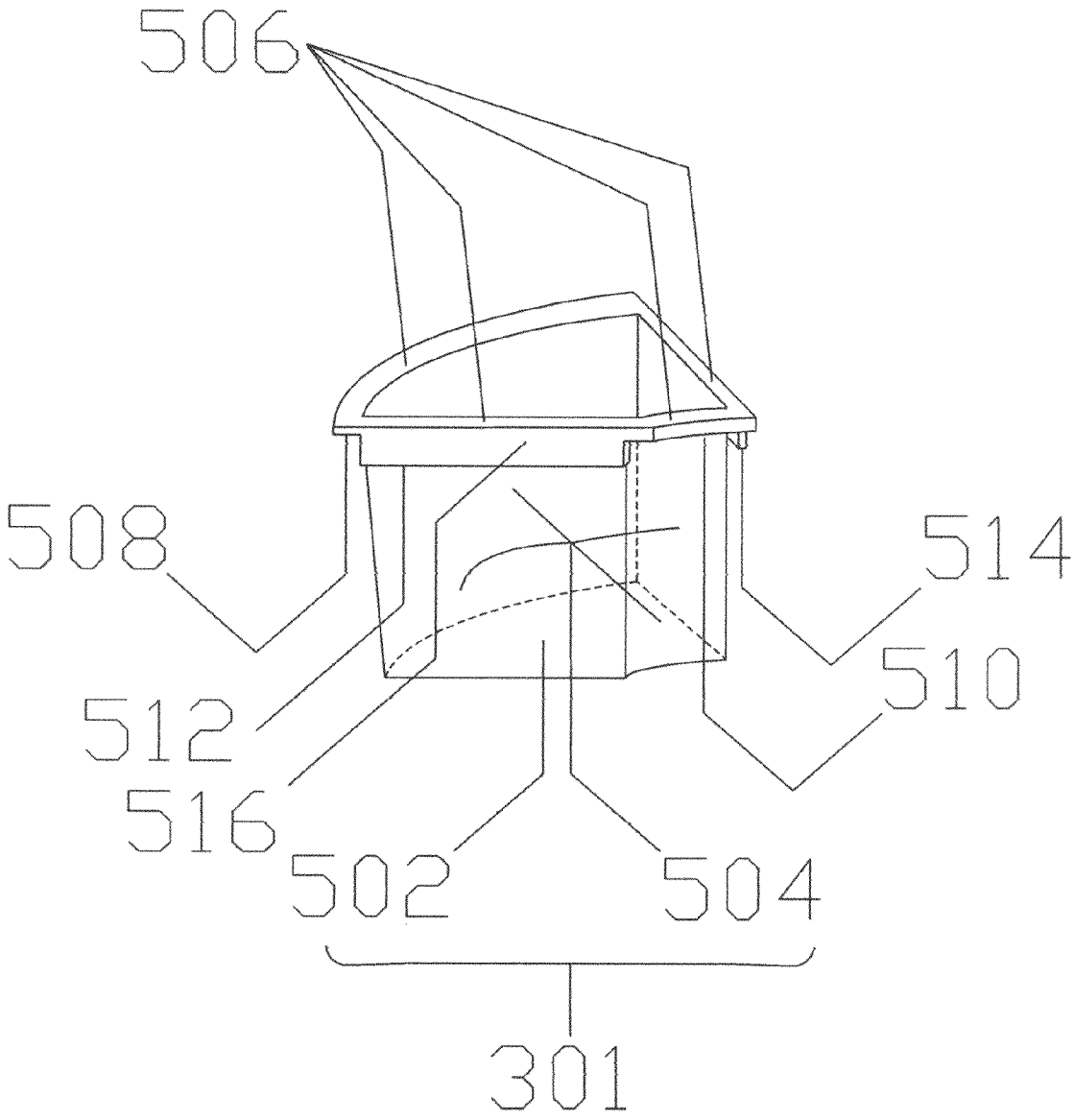
FIGS. 8A-8C, are various perspective views of the food containers according to the second embodiment.
Figure 8B:
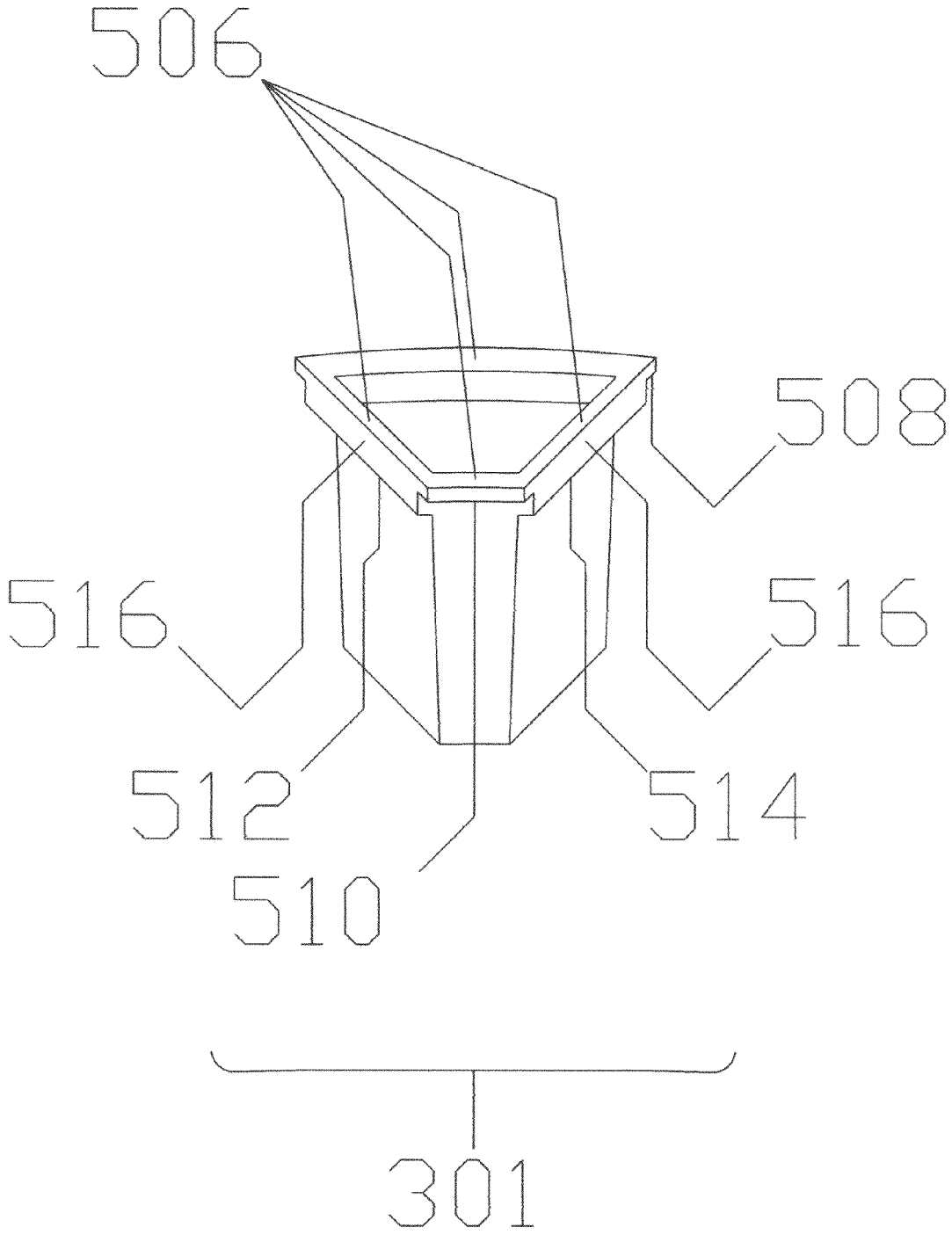

Referring to FIG. 2B, and to FIGS. 8A and 8B, each of the food containers 301 may include a bottom 502 and sidewalls 504 that may collectively define an interior space. The top of each container 301 may be open to facilitate adding and removal of items from the container.

The container 301 may include a flange 506 that may extend around the perimeter of the open top of the food container. As illustrated in FIG. 4D the flange 506 may be dimensioned such that portions at two opposing sides 508, 510 of the food container may rest on the respective lower ledges 175, 299 of the tray and the base of the housing of the cooling unit. The flange may either be integrally formed with the food container or attached to the container in a conventional manner.

At opposing sides 512, 514 of the food containers that may not rest on the ledges, may be sealing structures 516. The sealing structures 516 may extend downward from the flange 506 in a direction toward the bottom of the food container 301.

Figure 8C:
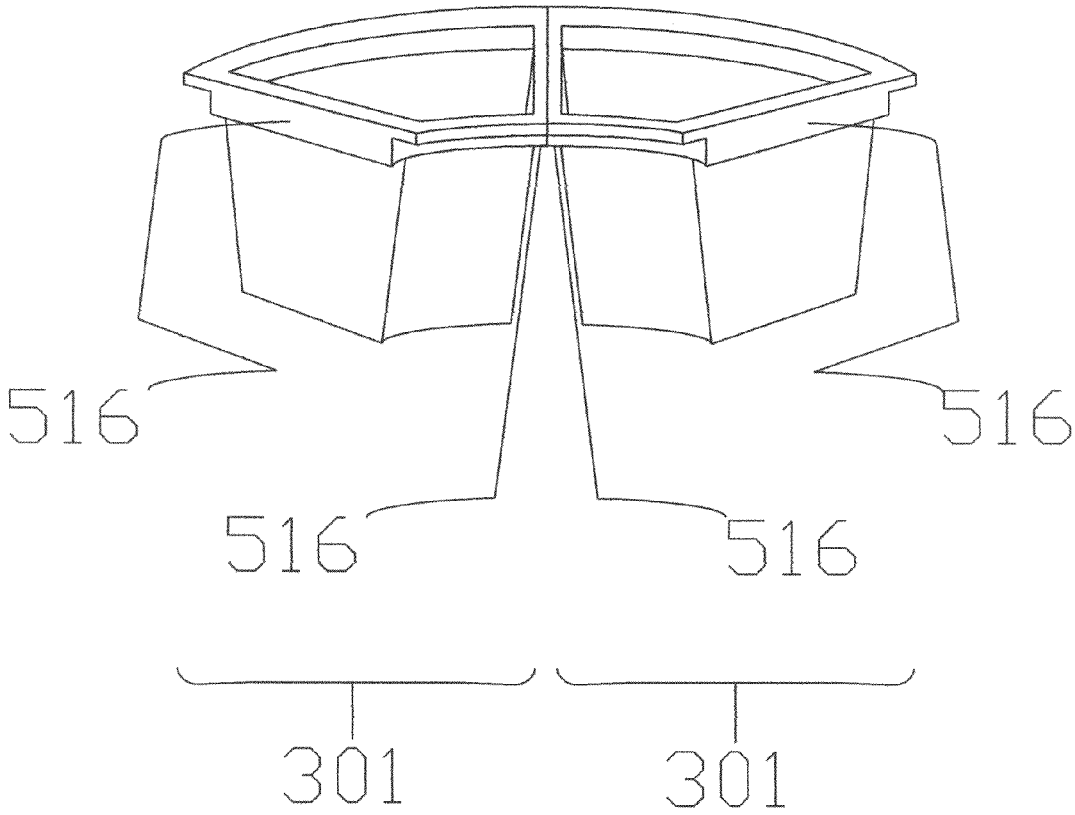

Referring to FIG. 8C, there are illustrated two food containers 301 in a side-by-side configuration as they would be found in the tray 101, The respective sealing structures 516 of the food containers may cooperate with each other, when they are suspended in the tray. By way of a non-limiting example, the sealing structures 516 may abut each other. The dimensions and configuration of the sealing structures 516 may vary. The sealing structures 516 may cooperate with sealing structures 516 of adjoining food containers 301 to prevent cooled air from flowing out of the tray at the point of contact between the containers when they are suspended in the tray 101.

The configuration and dimensions of each food container 301 may be varied. As illustrated in FIG. 4D, The containers may fit in and may be accepted by the tray 101. Non-limiting examples of the shapes of the food containers 301 include square and wedge shapes. Each of the plurality of containers 301 may either share a shape or be of different complimentary shapes. Also, the depth of the food containers may vary. The container may hold a desired amount of food and may be spaced from the bottom 156 of the inner shell 152 of the tray 101 when the container is suspended in the tray.

Additionally or alternatively, each of the containers 301 may be dropped into the tray 101 and suspended within the tray. Each container may rest on the ledge of the tray and the ledge of the base of the housing of the cooling unit.

The Tray Cover

Figure 10A:
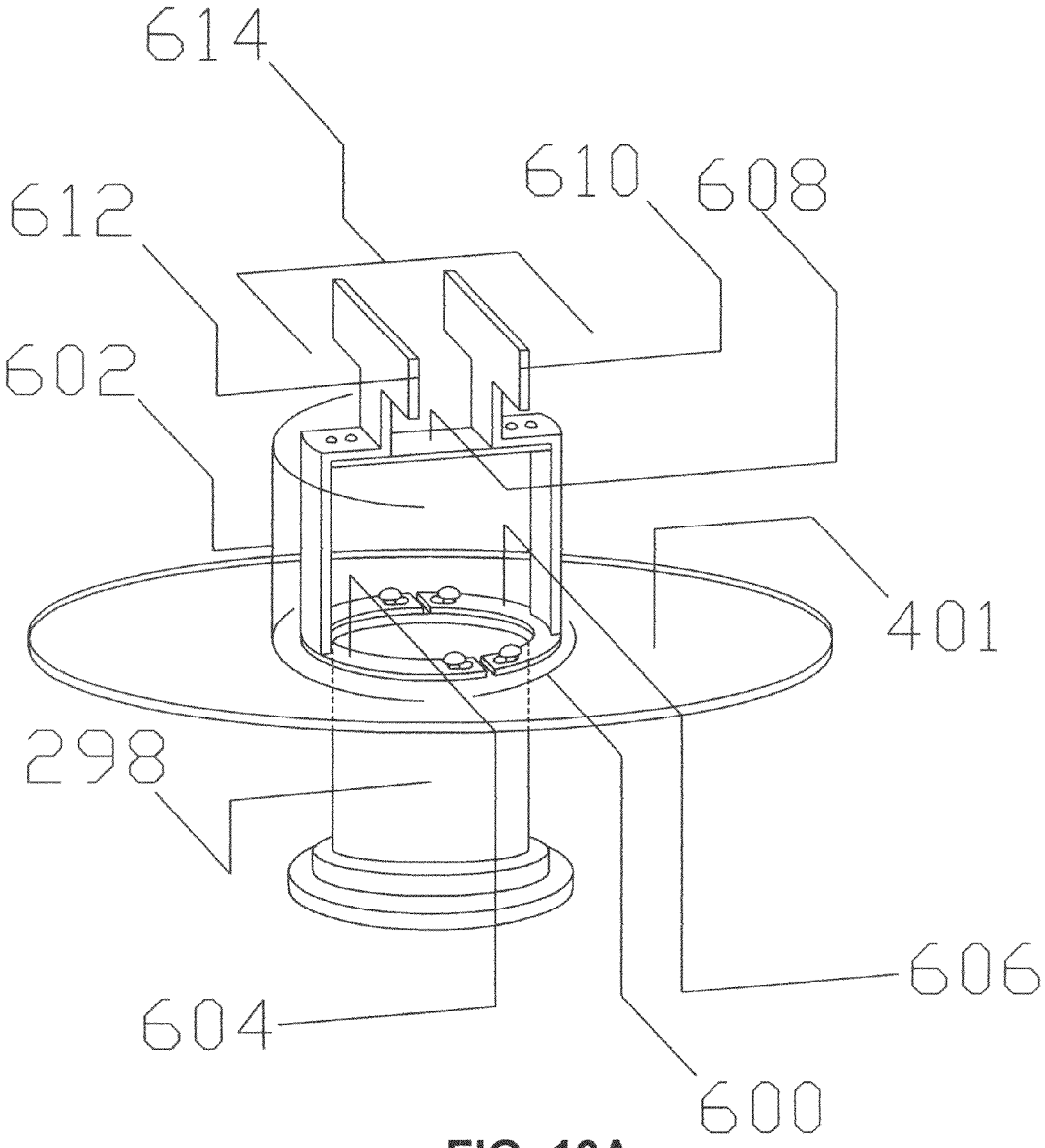
FIGS. 10A-10C are various perspective views of the tray cover according to the second embodiment.
Figure 10B:
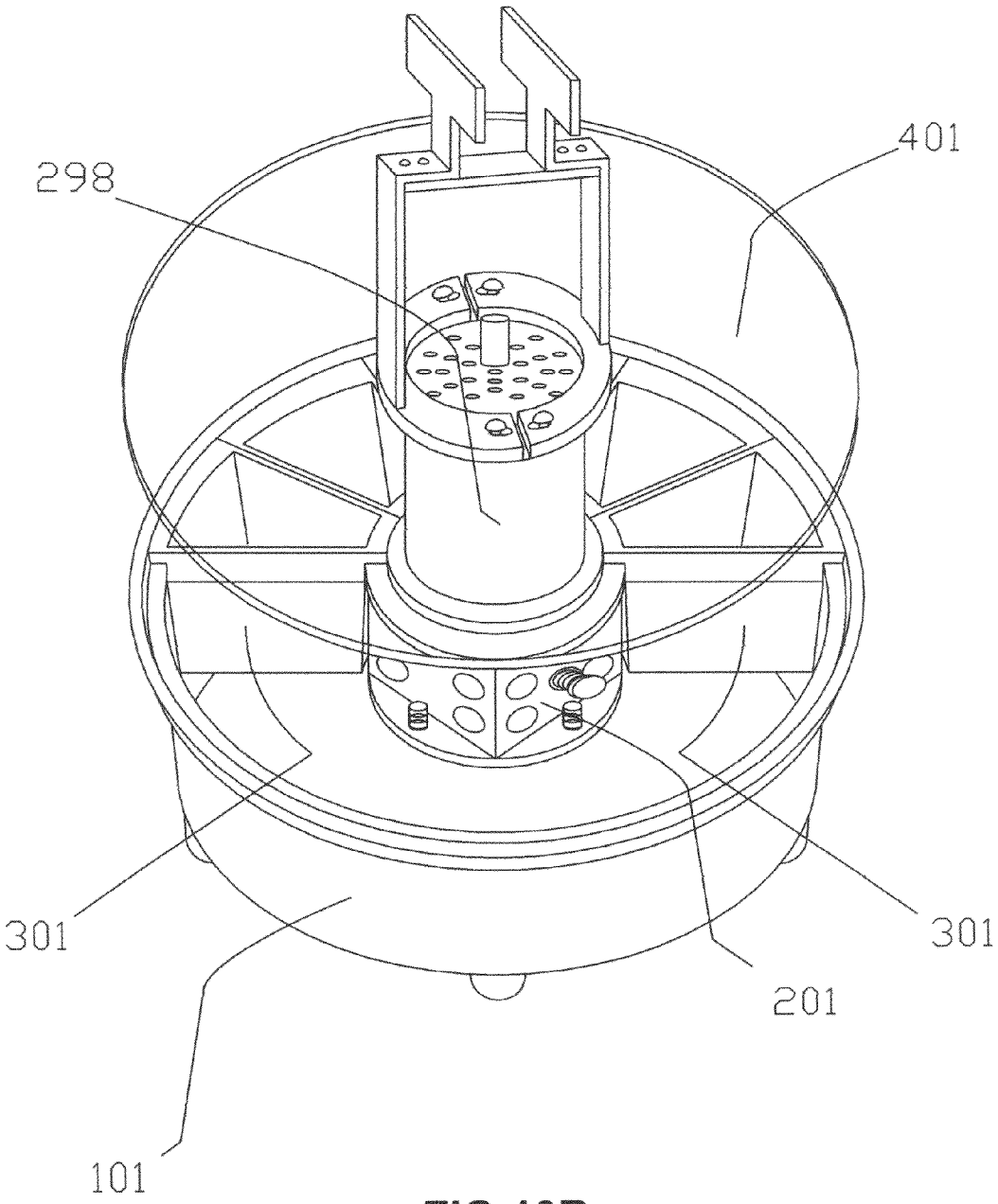

Referring again to FIG. 2A, 2B and to FIG. 10B there is shown the tray cover 401. The tray cover 401 may be generally disk-like or plate shaped. The tray cover 401 may sealingly cover the tray 101 when the tray cover is in the closed position. The dimensions and configuration of the tray cover 401 may vary. By way of a non-limiting example, when the tray 101 is round as it is illustrated in FIG. 10B, the circumference of the tray cover 401 may at least match that of the tray 101.

As illustrated in FIG. 10A, The tray cover 401 may be movably attached to the housing 298 of the cooling unit 201 by a tray cover attaching arrangement 602, the tray cover attaching arrangement 602 may include, by way of non-limiting examples, resilient or biased arrangements. For example, the attaching arrangement 602 may be a flexible ring 600 divided in two halves 604, 606. The diameter of the inner wall of the halves 604, 606 may be approximately equal to the diameter of the outer wall of the housing 298 of the cooling unit. The inner walls of the halves 604, 606 may clamp around the outer wall of the housing 298 of the cooling unit. The attaching arrangement 602 may include a handle 614. Clamping contact may be created by linking the two halves 604, 606 with a spring strip 608 centrally placed above the housing 298 of the cooling unit through the handle 614. The spring strip 608 may be formed any appropriate material. By way of non-limiting examples, the spring strip 608 may be formed of metal or plastic. A space between ends 610, 612 of the handle 614 may be maintained to allow flexing of the spring strip 608. When the ends 610, 612 of the handle 614 are forced together, the two halves 604, 606 may spread apart releasing their clamping contact on the housing 298 of the cooling unit. The shape and dimensions of the handle 614 may be varied. The handle 614 may be configured to facilitate selective movement of the tray cover 401 and to release clamping of the cover attaching arrangement 602.

Figure 10C:
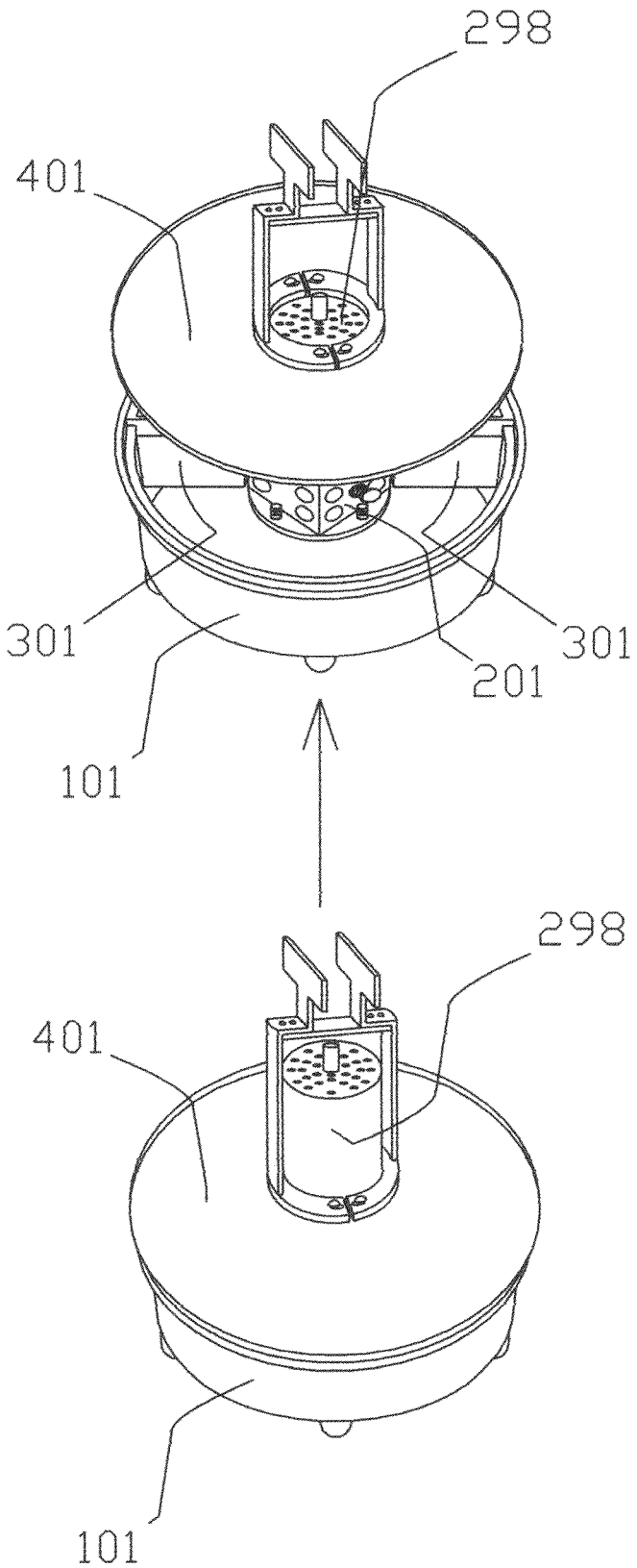

As illustrated in FIG. 10C and FIG. 11, The tray cover 401 may be movable along the longitudinal axis of the housing 298 of the cooling unit 201 from a closed position at which the tray cover 401 may sealingly contact the circumferential area of the tray 101 to an open position that may permit access to items contained in the food containers 301. More specifically, as illustrated in FIG. 6B, in the closed position, the tray cover 401 may contact upper ledges 174, 297 of the tray 101 and the base of the housing of the cooling unit 298 sealing the interior 164 of the tray from the top side.

As illustrated in FIG. 10B, and FIG. 11, when the tray cover 401 is in an open position, it may be suspended above the tray 101 at the cooling unit housing 298. In this position, the tray cover 401 may serve at least two functions. First, the tray cover 401 may serve as a so called "sneeze guard" that may prevent contamination of the items in the food containers 301. Second, the tray cover 401 may serve as a barrier that may keep the warm exhaust from returning to the cooled food containers 301.

Preparation of the Apparatus for Use

The preparation of the apparatus for use will now be discussed with respect to the first embodiment 100. To prepare the apparatus, the user may access the interior of the tray 100 by removing the tray cover 400, if it is not already removed. To remove the tray cover 400, the user may employ the optional handle 614 to raise or lower the tray cover 400 relative to the tray 100. As shown in operation 1102 in FIG. 11, the user may suspend the food containers 300 in the interior space of the tray, if they are not already therein suspended. Access to the interior of the tray may permit the user to insert food containers 300 into the interior of the tray.

Operation of the Apparatus

The operation of the apparatus will now be discussed with respect to the first embodiment 100. A user may place the apparatus on a stable, flat surface such as a tabletop. The user may energize the cooling unit 200. This may be accomplished in any one of several known ways, including plugging the apparatus into an electrical socket and/or turning the apparatus on via a switch or button 650 (shown in FIG. 1B). As shown in FIG. 11, in operation 1104, the energized cooling unit 200 may cool the air in the interior 120 of the tray 100. This cooled air, in turn, may cool the contents of the food containers 300 in the tray 100. As shown in operation 1106, the tray cover 400 may be lowered so as to shield the food containers 300 in the tray 100 from warm exhausted generated by the cooling unit. This may further aid in cooling the contents of the food containers 300. Cooling the contents may extend the period during which the food can be consumed. This may prolong the freshness of the food contained in the food containers which, coupled with the ease of use of the apparatus, and the ability to place refrigerated fruits and vegetables in convenient spots of a residence or a work place, may promote a more healthy diet.

Although embodiments of the present invention have been shown and described, it is to be appreciated that changes may be made in these embodiments without departing from the principles and spirit of the invention, the scope of which is defined in the claims and their equivalents.

What is claimed is:

1. A food tray comprising:

a tray having a container receiving space and a stepped outer sidewall including a lower step and an upper step;

a cooling unit providing cooled air to the space and having a housing with a stepped base that includes a lower step and an upper step, the cooling unit venting exhaust from an end distal to the base;

a plurality of containers each having a perimeter flange and, when the container is inserted into the space, portions of the flange are seated on the respective lower steps of the tray and the stepped base of the housing; and a cover configured to sealingly contact the upper step of the tray and the upper step of the base when the cover is in a closed position, the cover shielding the containers from the exhaust, and being movably attached to the housing and movable along the housing in a range that includes the closed position at which the cover contacts the upper step of the tray and the upper step of the base, wherein the lower step of the tray and the lower step of the base correspond with each other, and wherein the upper step of the tray and the upper step of the base correspond with each other.

2. The food tray of claim 1, wherein the containers have at least two straight sides, and two of the straight sides include contact walls extending from the flange, the walls abutting against contact walls of others of the containers so as to increase a seal therebetween when plural containers are received in the space.

3. The food tray of claim 1, wherein the flanges are below a level of the upper step of the tray and the upper step of the base.

4. The food tray of claim 1, wherein the flanges are dimensioned so that they are in contact with the cover when the cover is in the closed position.

5. The food tray of claim 1, wherein the steps and containers are dimensioned so that the containers are spaced apart from a bottom of the space.

6. The food tray of claim 1, wherein the containers are received so that air can circulate around the containers, and between the containers and at the bottom of the space.

7. The food tray of claim 1, wherein the lower step of the tray and the lower step of the base share a level and the upper step of the tray and the upper step of the base share a level.

8. The food tray of claim 1, wherein the stepped outer sidewall including the lower step and the upper step further includes a perimeter ridge extending above the upper step, and wherein the stepped base of the housing of the cooling unit including the lower step and the upper step further includes a perimeter ridge extending above the upper step.

9. The food tray of claim 1, wherein the cooling unit is freestanding, oriented axially relative to the tray, and the distal end is above the cover.

10. The food tray of claim 1, wherein the cooling unit is removably connected to the tray.

11. The food tray of claim 1, further comprising an attachment arrangement attached to the cover, the attachment arrangement including a handle.

12. The food tray of claim 1, wherein the cover is attached to the housing by a flexible ring assembly.

13. A food tray comprising:

a container accepting tray removably accepting at least two containers at portions of respective peripheral flanges of the containers, the tray having inner and outer ledges and a longitudinal axis, a seal being established between portions of the flanges and the inner ledge when the containers are accepted;

a cooling unit extending along the axis, having a base end proximate to the tray and a distal exhaust end from which warm air is exhausted, the cooling unit being freestanding, removably connected to the tray, and having a housing including a base with inner and outer ledges, a seal being established between portions of the flanges and the outer ledge of the base when the containers are accepted; and a movable cover, the cover extending between the outer ledge of the tray and the inner ledge of the housing, being movable along the axis from a closed position at which the cover sealingly contacts the outer ledge of the tray and the inner ledge of the housing, to an open position at which the cover is not in contact with the ledges, and being movably attached to the housing and shielding the tray from the exhaust air, wherein the inner ledge of the tray and the outer ledge of the housing correspond with each other.

14. The food tray of claim 13, wherein the cover is selectively suspendable above the tray via a resilient clamping arrangement.

15. The food tray of claim 13, wherein the cover is selectively suspendable above the tray via a tray cover attaching arrangement, the tray cover attaching arrangement including a flexible ring selectively engaging at least a portion of the cooling unit, and a handle including a spring strip creating force on the flexible ring to engage the at least a portion of the cooling unit.

* * * * *